United States Patent [19]

Schmidt

[11] Patent Number: 4,633,683

[45] Date of Patent: Jan. 6, 1987

[54] METHOD FOR THE MANUFACTURE OF PATTERNED PILE FABRICS AND CIRCULAR KNITTING MACHINE THEREFOR

[76] Inventor: Walter R. Schmidt, Dr Gschmeidler-Str. 19/2, A-3500 Krems/Donau, Austria

[21] Appl. No.: 577,321

[22] Filed: Feb. 8, 1984

Related U.S. Application Data

[63] Continuation of Ser. No. 279,003, Jun. 30, 1981, abandoned.

[30] Foreign Application Priority Data

Jun. 30, 1980 [DE] Fed. Rep. of Germany ..... 3024705

[51] Int. Cl.[4] ..... D04B 9/12

[52] U.S. Cl. ..... 66/9 R; 60/93; 60/194; 60/40

[58] Field of Search ..... 66/9 R, 93, 194

[56] References Cited

U.S. PATENT DOCUMENTS

| | | | |
|---|---|---|---|
| 1,683,699 | 9/1928 | Rubenstein | 66/9 R |
| 1,801,167 | 4/1931 | McAdams | 66/93 X |
| 2,094,180 | 9/1937 | Mishcon | 66/9 R |
| 2,168,869 | 8/1939 | Getaz | 66/9 R |
| 2,710,527 | 6/1955 | Radin | 66/93 |
| 2,715,824 | 8/1955 | Krauss et al. | 66/93 |
| 3,406,538 | 10/1968 | Beckenstein | 66/93 X |
| 4,020,653 | 5/1977 | Mishcon et al. | 66/93 |

FOREIGN PATENT DOCUMENTS

| | | | |
|---|---|---|---|
| C 671801 | 1/1939 | Fed. Rep. of Germany . | |
| 2322384 | 11/1974 | Fed. Rep. of Germany . | |
| 2343886 | 3/1975 | Fed. Rep. of Germany . | |
| 2423700 | 11/1975 | Fed. Rep. of Germany . | |
| 227795 | of 1926 | United Kingdom | 66/93 |
| 462662 | 6/1935 | United Kingdom . | |

*Primary Examiner*—W. Carter Reynolds

*Attorney, Agent, or Firm*—Oblon, Fisher, Spivak, McClelland & Maier

[57] ABSTRACT

Patterned pile (terry or plush) fabrics are made on circular knitting machines with cylinder and sinker ring or latch needles and pile elements (pile sinkers, pile hooks, latch needles). The pile elements are not selected, but perform their pile forming motions every knitting cycle. The latch needles of the cylinder are, however, selected both for knitting desired structures in the ground or base fabric and for forming the pile loops in the desired pile regions. The needles selected to form pile loops engage the pile thread fed at a higher level than the ground thread, which is fed at a level such that it is not affected by the pile elements, e.g. below the webs of pile sinkers. The ground thread is held in non-pile forming needles with their hooks at the level of the pile elements while the pile thread is fed to further extended needles which are then retracted to the same level as the needles holding the ground thread before all the needles are retracted to the knock-over position.

7 Claims, 27 Drawing Figures

FIG. 24
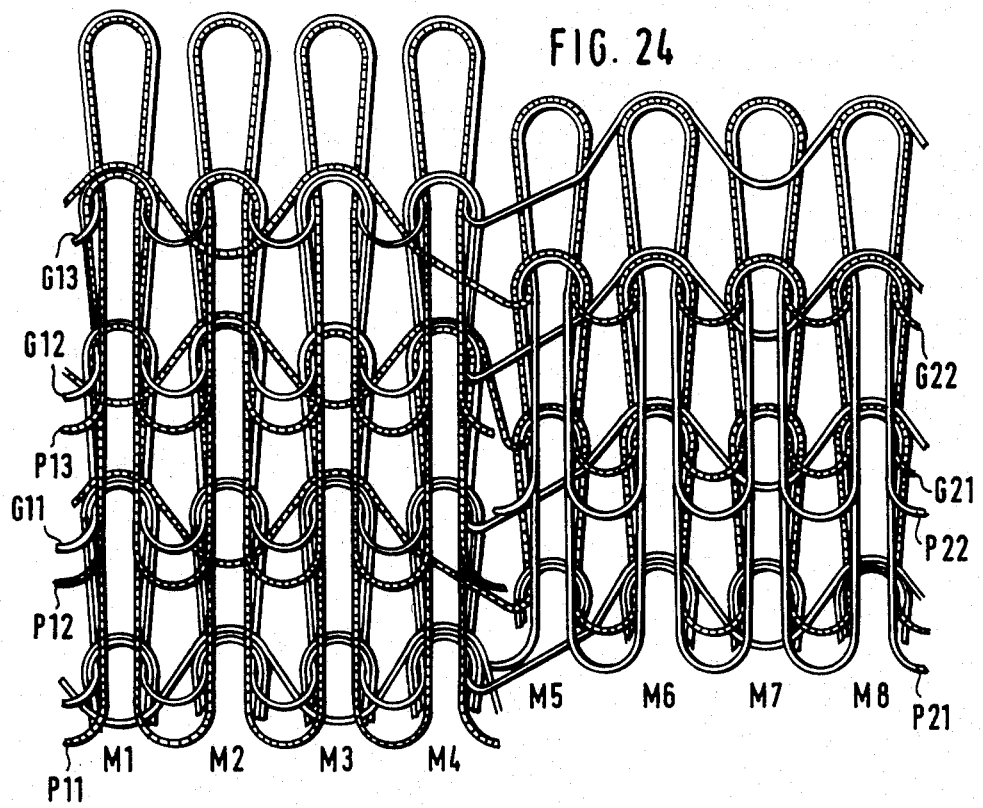
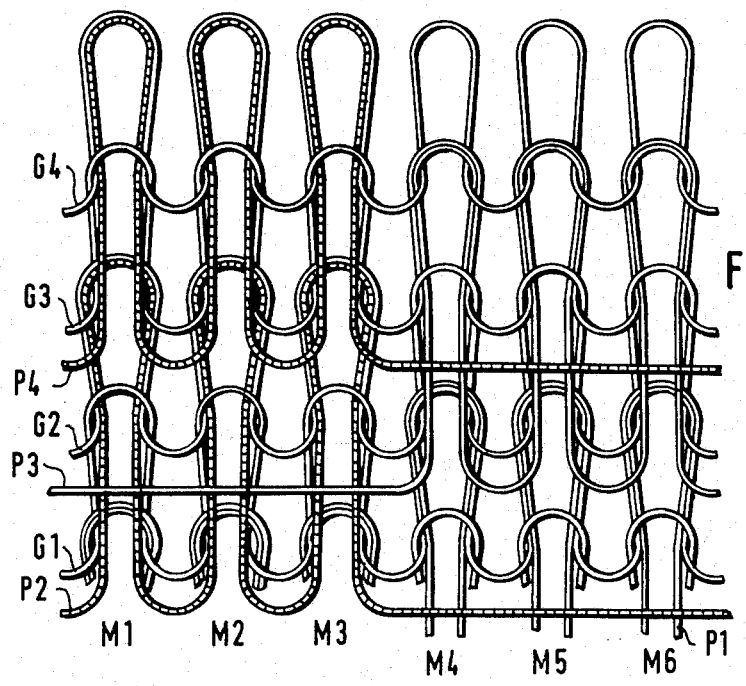
FIG. 22

METHOD FOR THE MANUFACTURE OF PATTERNED PILE FABRICS AND CIRCULAR KNITTING MACHINE THEREFOR

This application is a continuation of application Ser. No. 279,003, filed June 30, 1981 now abandoned.

The invention relates to methods for the manufacture of patterned pile (terry or plush) fabrics on circular knitting machines with cylinder and sinker ring or with cylinder and dial in which by selection only of latch needles knitting the ground (or base fabric) patterning limitations of known methods are avoided, reliability of production is increased and, in particular in the production of colour patterning, the pile density may be increased as desired. This is achieved by, at any given time, knitting together with the ground thread (base yarn) at least one pile thread (terry or plush yarn) to form pile loops according to a desired pattern through suitable needle selection, while the ground thread is knitted into the ground at least by some of the previously unselected needles. A further pile thread can be knitted in with the ground thread where the first pile thread misses. As pile thread floats lie on top of the pile face, it is necessary in colour patterning to crop and remove these pile thread floats by one or more cropping processes in the finishing processes, as is usual in velour finishing.

BACKGROUND TO THE INVENTION

Several possibilities already exist for patterning knitted pile fabric. Usually, such fabrics are produced on machines with cylinder and sinker ring by feeding a ground thread to all needles raised to the knit position and thereafter retracted to the feeding position, the ground thread being fed under the nebs of the sinkers selected ones of which are then moved by a selection device (pattern wheel) so that their nebs come between the shafts of the needles. The pile threads are fed to the needles simultaneously above the sinker nebs and then the needles are retracted to the knock-over or cast-off position. In this way, pile loops are formed from the pile thread above all selected sinker nebs, while ground and pile threads are laid as short sinker loops over the knock-over edges of the unselected sinkers. Colour patterning is effected by feeding different coloured pile yarns at successive feeders and selecting each sinker usually only once during a colour cycle.

It is moreover already known from U.S. Pat. No. 2,710,527 to actuate all sinkers for pie loop formation, but either to raise the needles to the knit position or leave them in the miss position, by means of a patterning device. The unselected needles pick up neither ground nor pile threads. The fabric produced by this method is in any event known from DE-PS 664.750.

A further possibility for patterning pile fabric is given in U.S. Pat. No. 2,715,824. Here, a ground thread is fed to all fully raised needles and these are then retracted to an intermediate position in which selected needles are again raised to the tuck position and a pile thread is fed to them.

The combination of the selection of sinkers with the selection of needles is described in DE-PS 681.180. By combination of sinker and needle selection, it is possible to select sinkers to form pile loops between knitting needles in pile sections while sinkers are not selected between such pile sections, individual needles being raised to the tuck position in order to tuck in ground and pile threads so that these threads are alternately tucking and missing in these sections (laid-in threads).

The possibility of knitting two pile threads with one ground thread according to DE-PS 664.750 is known from the method described in DE-PS 671.333.

A number of possibilities for producing patterned pile fabrics would also apply to machines with cylinders and dials. The task of forming pile loops on the sinker nebs is then taken on by one of the two sets of needles (e.g. DE-PS 706.809) or the pile sinkers provided instead of one set of needles (e.g. DE-PS 1.221.756) or pile hooks (e.g. DE-PS 1.816.846, U.S. Pat. No. 3,241,337, DE-OS 2 704 295, DE-OS 2 918 903).

The methods referred to and the fabrics produced thereby have a number of disadvantages.

Colour patterns according to the current method, in which only selection of the pile elements is effected, have a reduced pile density dependent on the colour cycle. Thus, in a two colour pattern, pile loops will be formed in a plain coloured area only in every second course. Between these courses having pile loops run normal courses in which the other coloured pile thread is knitted and thereby partially strikes through. By using this thread thus when it is not used for pile loop formation, a substantial part of it is needlessly wasted.

Colour patterns according to U.S. Pat. No. 2,710,527 are characterised by high pile density. Since the ground threads of one pattern colour are floating over the pattern area knitted from the other ground threads, these floats limit the width of single colour pattern areas, since—in order to bring the pattern into evidence—the floated pile threads must be cropped and removed. In doing this, the longer ground thread floats could also be raised and cut, as a result of which the fabric will have faults.

Through the laying-in of the ground and pile threads in a desired pattern as described in DE-PS 681.180 it is certainly possible to have a large scale pattern, but, however, this has the disadvantage that two separate knitting elements in the knitting process—needles and sinkers—have to be selected synchronously with regard to each other. Thus not only is the machine expensive, but increased costs are also incurred for the setting up, adjusting and monitoring of the pattern. This also applies to the possibility described in BG-PS 813,357 to interrupt the pile formation. Here too the pile-forming elements and the needles producing the ground fabric must be separately controlled, but synchronised one with the other. This has the disadvantage that the pile threads are fed ahead of the ground threads. As the latch needles must be raised to the knit position between pile and ground threads, their hooks therefore rise over the pile elements and can, particularly at the edges, readily engage the pile threads unintentionally and knit them.

If one tries to produce colour patterning according to U.S. Pat. No. 2,715,824, one could save a substantial amount of pile material as compared with the previously described methods. After being fed, the ground thread is guided over the sinker nebs and only drawn under the sinker nebs during the feeding of the pile thread by means of unselected needles. In order to guarantee that the ground thread is guided under the sinker nebs, the unselected needles must be retracted, particularly when using low pile sinkers, very close to the knock-over edges of the sinkers. This does not prevent the risk that previously knitted stitches will slide over the needle head to form unintentional stitches whereby the unrestrained feeding of thread to the actual knitting operation is interrupted and this leads to faults in the knitting. It is however necessary that when selecting needles to take up the pile thread, not to select adjacent needles, otherwise the ground thread can rise with the needles and is not guaranteed to engage under the sinker nebs. The tendency of the ground thread to rise with the selected needles is increased because the closed latches of the rising needles have to be opened simply by thread tension, which presupposes a certain quality of material for the ground thread. As a result, the range of possible pattern specifications is limited; in any event, in colour patterning, a reduction of pile density must be accepted.

Patterned pile fabrics, in which, according to DE-PS 671.333, two pile threads are knitted alternately with a ground thread, exhibit the highest possible pile density, but the patterning is achieved by using seperate the sets of needles, which must be guided in separate cam-tracks independently of one another. While the two sets of needles engage the pile threads fed to them at the same height, one set of needles must be retracted after feeding the first pile thread, while the other is raised. This excludes the use of a conventional selection device which acts on only one set of butts and can thus only effect a movement of one set of needles. A further disadvantage is that while the first pile thread is fed between the minimally separated heads of the needles of the two sets it must nevertheless remain behind the lower needle heads of one set of needles. It will be appreciated by anyone skilled in the art that precise feeder adjustments and exact needle tolerances are required, since otherwise needles of the lower set that may be bent to the rear after the feeding of the first pile thread can lie in front of the pile thread on the next succeeding upstroke, or, alternatively, the pile thread feeder can be easily damaged by projecting or defective needles. Precise setting of the sinker ring is required in any event in order to lay the ground thread fed over the sinker nebs under, and the previously fed pie thread above the sinker nebs. From the drawings it can be clearly seen that the feeding of the ground thread under the sinker nebs is on that account not possible since for this the sinkers must be retracted further and then come too late for the first pile thread to be laid over the sinker nebs. According to this process, the number of pile threads that can be worked with in each complete machine course is limited to two.

SUMMARY OF THE INVENTION

The object of the invention is to develop methods for patterning knitted pile fabrics in which the latch needles allotted for knitting the ground fabric can be selected serially as desired by known selection devices, while the pile elements intended to form the pile loops—sinkers, pile hooks, needles—are guided without selection through the loop forming motions. In this way, it will also be ensured that the ground thread is always properly fed beneath the sinker nebs and is not affected in any way by the needle latches it has to open. Further, it should be assured that, in the region where a pile thread misses as many needles as desired, the ground thread is engaged by all or a number of these needles and, either singly, or with an additional pile thread, is knitted into with the ground fabric. Finally, it will further be ensured that in feeding two pile threads at one feeder the needles which are raised to different heights should have an adequate spacing one from another, in order that the pile threads are laid in properly and thus that the needles engaging the second pile thread are not allowed to be present in the region of the first pile thread.

This object is achieved either in that the ground thread is fed in known manner to all needles raised from the miss position to the tuck or clearing position or retracted from their full extension to the feeding position, whereupon each needle which knits only the ground thread is retracted to an intermediate position in which the latches of the needle hooks close and only the needle hooks project above the sinker nebs, which are simultaneously moved between the needles, so that the fed pile thread is only laid into predetermined needles which are thereupon retracted to the level of the previously retracted needles and then together with these to the knock-over position, or in that the needles intended to engage a pile thread are raised above the needles that only engage the ground thread and only pile thread is fed to these needles, whereupon they are retracted to the level of the needles already brought to the feeding or tuck position, and a ground thread is fed below the sinker nebs which are moved between the needles, whereupon either all needles are retracted to the knock-over position or all needles with the previously engaged pile thread or, as the case may be, all needles which knit only the ground thread are retracted to an intermediate position in which the latches of the needle hooks close, but the needle hooks project over the sinker nebs which have simultaneously been positioned between the needle shafts, so that the first pile thread lies on top of them, whereupon the needles remaining in the feeding position are fed with a second pile thread and then these needles are retracted to the position the other needles were retracted to previously and then, together therewith, retracted to the knock-over position.

The advantage of this method is that with any desired needle selection, it is guaranteed that the ground thread is fed beneath the sinker nebs, the ground thread is not strained by opening the latches, it can be knitted on any desired number of selected needles, singly into the fabric ground, while the pile thread misses. Through appropriate needle selection and control the pile density can be increased in colour patterning. By the spacing of the heads of needles selected to different positions while feeding a pile thread, proper feeding in can be guaranteed. In feeding two pile threads at one feeder it is sufficient to select the needles by a known selection device, since the selected set of needles is first raised over the tuck and feeding positions in order to engage the first pile thread, which is fed at a higher level, and then, after feeding the ground thread to this needle set, the set is retracted, with the same selection, from the feeding position, whereby the unselected needles remaining in the feeding position engage the second pile thread. Through an additional needle selection device, a number of the needles can work with ground threads only, so that two feeders with a total of four pile threads can form a complete course. With this, according to the method, a series of already known knitting structures can be produced with improved reliability, and additionally many new dense pile patterned fabrics, particularly in different pile materials, can be produced without technical limitation.

BRIEF DESCRIPTION OF THE DRAWINGS

The invention will now be more particularly described with reference to the accompanying drawings, in which

FIG. 22 is a diagrammatic representation showing the stitch structure of a first fabric produced according to the invention, FIGS. 24 and 25 are representations like FIG. 22 of two more such fabrics.

DETAILED DESCRIPTION OF THE INVENTION

Figure 1:
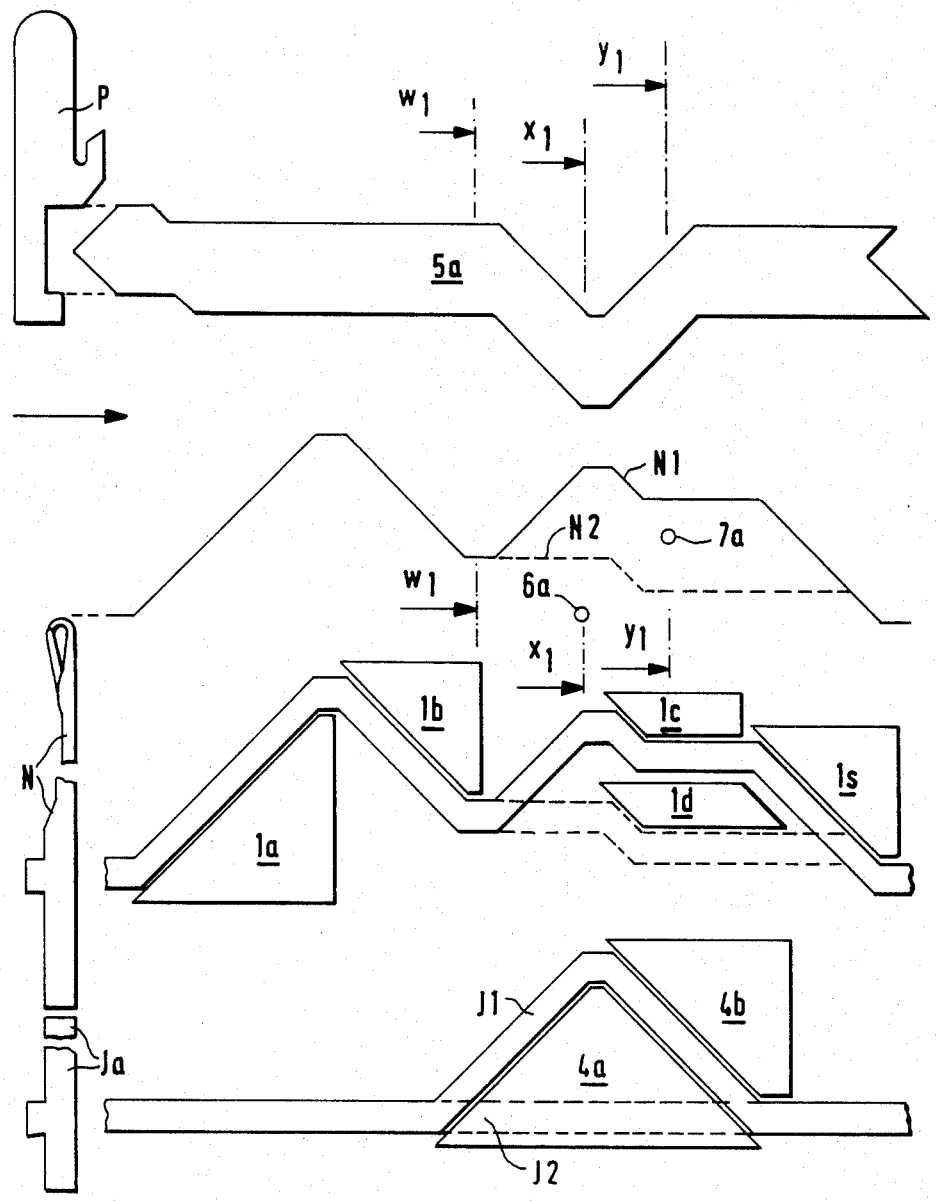
FIG. 1 is a schematic diagram of a cam section at one position of a knitting machine adapted to carry out the method of the invention.
Figure 2:
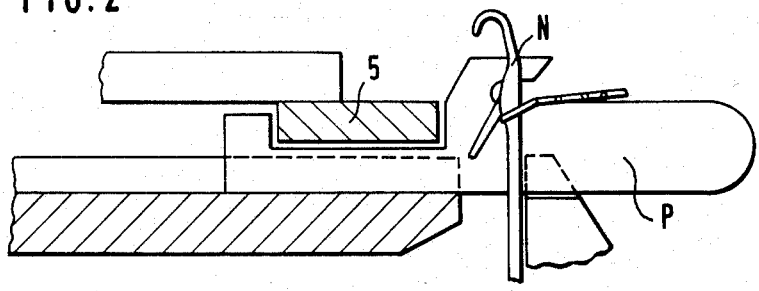
FIG. 2 is an elevation showing the relative positions of needle and sinker at a position corresponding to "W" in FIG. 1, FIGS. 3 and 4 are elevations like FIG. 2, showing relative positions of needles, sinkers and feeders at positions corresponding respectively to "X" and "Y" in FIGS. 1, 5, 6, 13, 14, 15 and 16.
Figure 3:
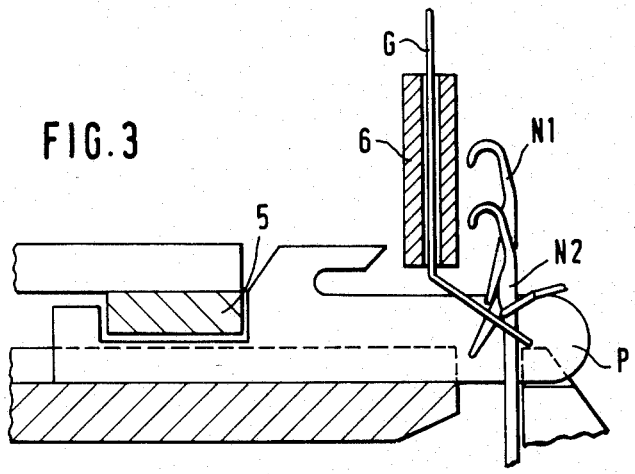

FIG. 1 shows the arrangement and control during a knitting cycle of latch needles N mounted in a cylinder. The movement sequence of the pile forming elements—pile sinkers P—is effected according to the generally known principle for producing a plain pile (plush or terry) fabric on machines with cylinder and sinker ring with cam 5*a*. Below the needles N, the elements Ja of a patterning device are provided cooperating in known manner. The knitting cycle starts in known way with the raising of all needles through cam section 1*a* into the knit (latch clearing) position and the retraction by cam section 1*b* to the feeding position. The previously knitted stitches open the latches, slide over them on to the needle shafts and are then moved behind the latches by the retraction of the needles. Cam section 1*b* retracts the needles to the extent that they are as low as possible without closing the latches by the stitches lying behind them. This needle position is reached at "W1" in FIG. 1 and shown in FIG. 2; the sinkers P can now be retracted by cam 5*a*. Then the needles N1 are raised by cooperating jacks Ja along path J1 by the cam section HS 4*a* of the patterning device—the previously knitted stitches will remain behind the needle latches. The pile sinkers P are in fact retracted by cam 5*a* when cam section 1*b* retracts the needles. Then, at the latest after selecting the needles, the ground thread is fed from feeder 6*a* under the sinker nebs at "X1" in FIG. 1. This is shown in FIG. 3, where selected needles N1 stand higher than unselected needles N2 and the ground thread G is fed from feeder 6*a* beneath the nebs of the retracted pile sinkers P but above the needle latch ends. Now the pile sinkers are extended by cam 5*a* so that their nebs (with upper, pile forming edges) lie between the needle shafts. In order to ensure that the pile thread is properly laid in, the unselected needles N2 are now also retracted by cam section 1*d* to the intermediate position in which their needle hooks are closed, by the previously formed stitches raising the latches, and just project over the sinker nebs. In the selection of the needles, it must be arranged that the height difference will be fully utilised, so far as allowed by the length of the needle latches, in order to guarantee a separate guiding of the needles N1 and N2. That means that the selected needles should be raised as high as possible to avoid the possibility that the fed ground thread can slide on to the needle shaft. For that reason there is provided, for this principle of selection, a cam section 1*c*, which retracts the selected needles to some extent shortly after the cam section 1*d* has retracted the unselected needles N2. This ensures a safer guiding of the ground thread G and the hooks of the needles N1 and N2 have a large spacing between them so that the pile thread can be fed with greater safety between the hooks of the two sets of needles. These needle positions are reached at "Y1" in FIG. 1 and shown in FIG. 4.

Figure 4:
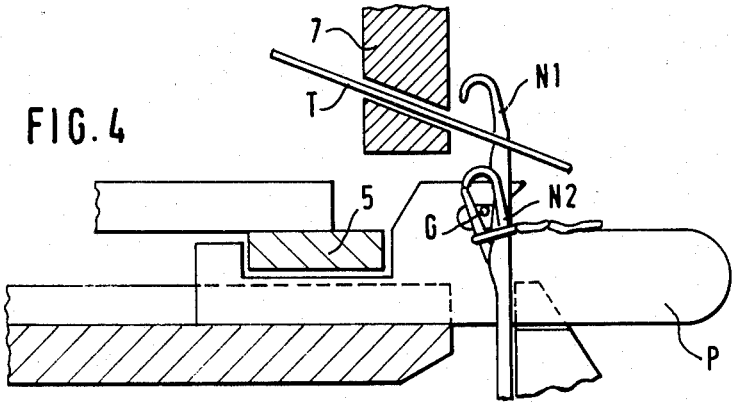

The selection of the needles can also, however, be effected after the feeding of the ground thread and after the pile sinkers are moved with their nebs between the needle shafts. FIG. 4 shows the feeding of the pile thread T. This is fed to the open hooks of the selected needles N1. Since the hooks of the needles N2 are already closed, there is a grater certainty that the pile thread will not be engaged by the unselected needles N2. The ground thread is held in the throats of the sinkers P, in the needle hooks of the needles N2 and on the latches of the needles N1. After the feeding of pile thread, the needles N1 are retracted to join the needles N2 by the stitch cam 1*s* and all needles retracted together to the knock-over position. In this way, the needles N1 knit stitches from ground and pile threads together, which are connected by the pile loops lying over the sinker nebs. The needles N2 have knitted stitches from the ground thread G only. In the region of the needles N2, the pile threads lie as thread floats over the sinker nebs.

As seen from the description of FIG. 1, it is assured that a separate guiding of the needles N1 and N2 is possible after their selection, wherein needles are not be raised above the feeding position, and in which needles take up the same position as in the tuck position, the stitches lying not on, however, but behind the latches. In the example described, it is necessary for that reason to use a needle with the longest possible latch. That means that all needle movements are increased and on that account the possible number of feeders on a circular knitting machine of given circumference is reduced.

Figure 6:
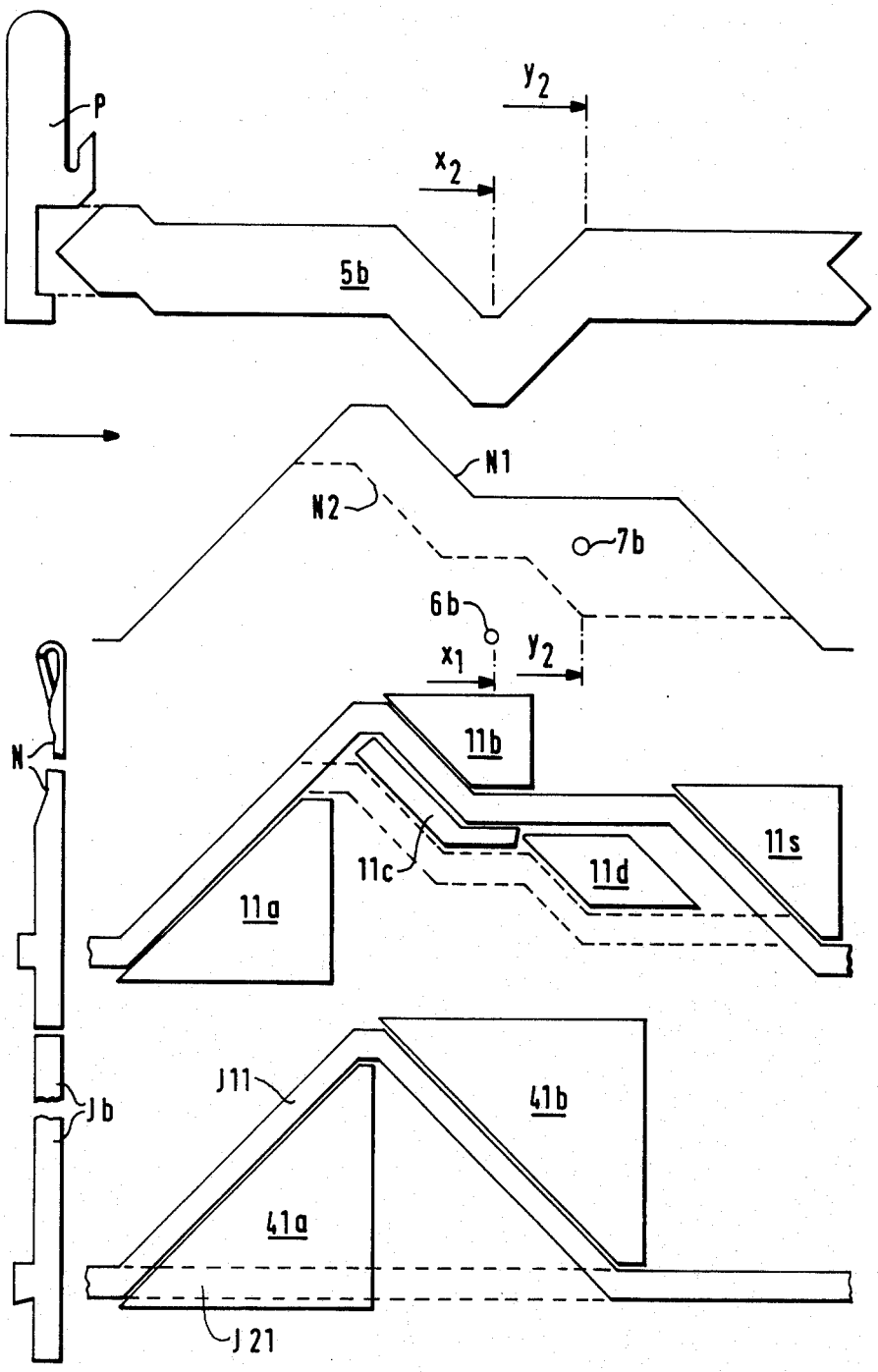
FIG. 6 is a diagram like FIG. 1 of another different cam section.

A further example is shown in FIG. 6. Here, all needles are raised at least to the knit or clearing position by cam 11*a*, the selected needles N1 being raised above this by the patterning device 41*a*. By this means, an adequate difference in height is produced so as to ensure that the needle sets N1 and N2 are moved separately. All unselected needles are retracted by the cam section 11*c* to the lowest feeding position, and all selected needles are retracted by the cam section 11*b* to the highest feeding position at $X_2$, as shown in FIG. 3. At the same time, the sinkers are retracted so that the ground thread G can be fed by feeder 6*b* at $X_2$ in FIG. 6. The sinkers are thereupon moved with their nebs between the needle shafts and at the same time the needles N2 retracted by the cam section 11*d* to such an extent that they stand with their hooks just over the sinker nebs. After the pile thread is fed at $Y_2$ (see FIG. 6) by feeder 7*b*, all needles are retracted by the stitch cam 11*s* to the knock-over position.

Figure 5:
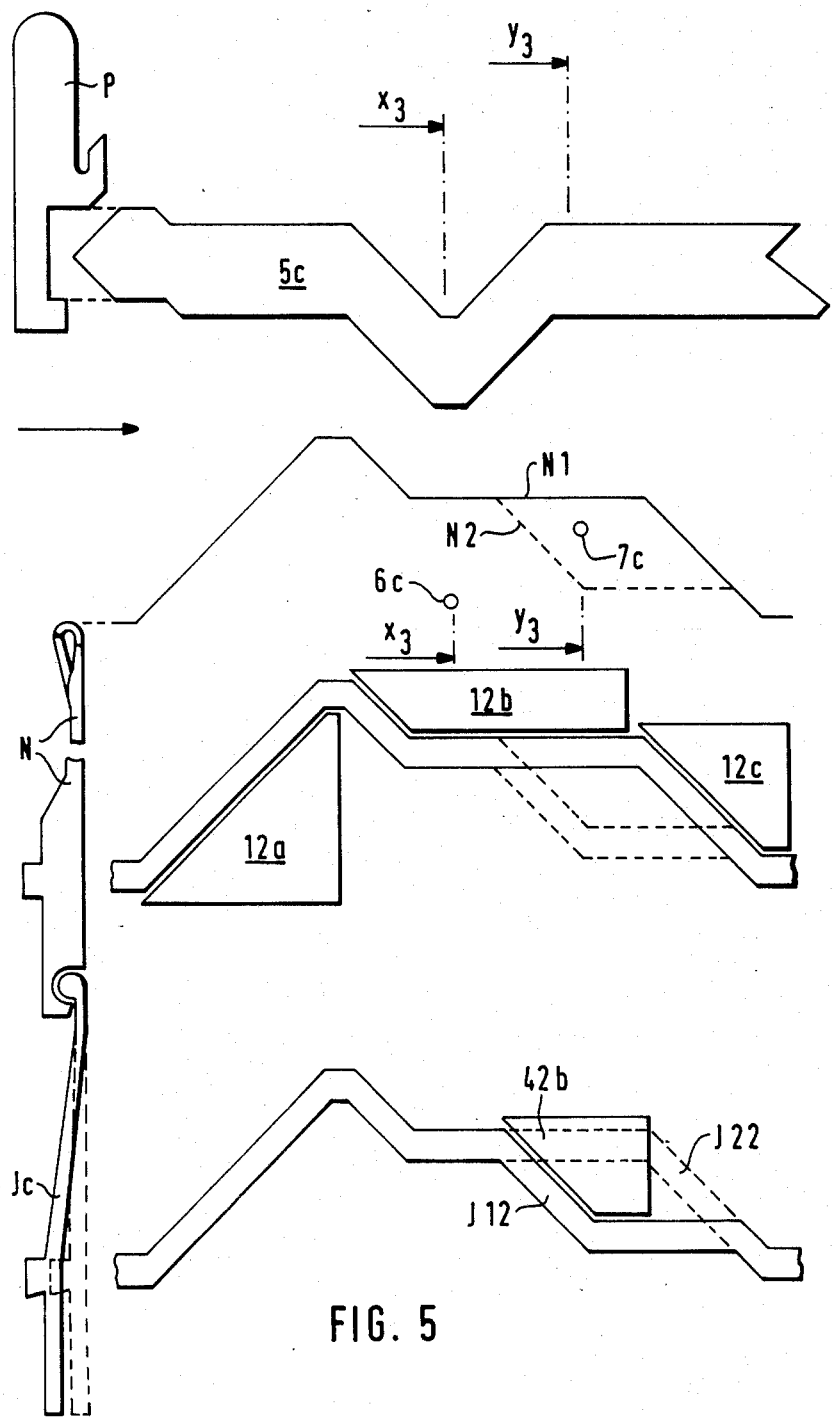
FIG. 5 is a diagram like FIG. 1 of a different cam section.

The ideal solution in regard to positive needle guiding and minimal thread requirements is shown in FIG. 5. Here, a conventional patterning device is used in which the control elements J*c* of the selection device are inserted pivotally into the needles N so that the needles can be raised and retracted by cams of the patterning device. As already described, all the needles are first of all raised to the knit or clearing position by cam 12*a* and then retracted to the feeding position, by the cam section 12*b*. At the same time, the sinkers are retracted by cam 5*c* so that the ground thread can be fed by feeder 6*c* to all needles at $X_3$ standing at the same height as needle N1 in FIG. 3, as this results in the production of plain pile fabrics. Now the pile sinkers are moved with their nebs between the needle shafts. Then each needle N2 is selected by the selection device, and should not engage a pile thread. Thus, are then, after feeding the ground thread, the needles N2 are retracted by cam 42*b* of the patterning device at $Y_3$ to the position shown in FIG. 4, while the needles N1 remain in the feeding position. The pile thread T is fed from feeder 7*c*, whereupon all needles are finally retracted into the knock-over position by the stitch cam 12*c*.

Simpler patterns can be made by the method described with reference to FIG. 5 and also by the use of separately controlled needle sets of different lengths and/or butts at different levels.

With the examples described, a number of pattern structures can be produced. Thus desired structures can be produced by different pile loop lengths, according as whether the pile loops connect two adjacent stitches or miss over one or more stitches. In contrast to U.S. Pat. No. 2,715,824 each region in which the pile thread does not appear can extend over as many stitches as required. This goes also for colour patterning according to FIG. 22. In FIG. 22 is shown a two colour jacquard fabric in which a first pile material P1 and P3 is knitted into wales M4, M5 and M6 with the ground threads G1 and G3, while in the wales M1, M2 and M3, the ground threads G1 and G3 knit stitches on their own. The intermittent floats of the pile thread that miss over the ground fabric lie on top of the pile face. They must be cropped in order to bring the colour pattern into effect. This is advantageously done by at least one cropping process after the knitting. Such cropping processes are in any event performed for cut pile (velour), so that in such cases, no additional cost will be incurred. If in the patterning it is arranged that the pile threads always miss at least a predetermined number of stitches, it is then possible, by corresponding adjustment of the cropping machine, to cut only the floats. For this, the least number of stitches it is required the pile thread to miss depends upon the gauge and the materials being used and can be determined by experiment.

Longer floats of the pile thread could be cut advantageously in the machine. For this purpose one can use inside the dial plate of the knitting machine cutting devices or hot wires and air nozzles or thread clamps to hold the extracted threads as in small-diameter (seamless) machines. As such devices are also used in circular machines, it is not necessary to describe their arrangment.

If the raising of the needles is performed exclusively by the patterning device, all the patterns can additionally be produced according to U.S. Pat. No. 2,710,527, with all the previously described and noted disadvantages.

The carrying over of the examples already described for machines with cylinder and sinker ring into machines with cylinder and dial is possible without further ado. Some possibilities are shown in FIG. 7 to FIG. 12.

If the pile loops are knitted by latch needles, according to DE-PS 706.809 or a method described in the trade journal "British Industry", February, 1974, pages 46–52, a relatively unproductive feeder is required in which only those needles raised to the clearing position and not supplied with threads must be retracted to the knock-over position in order to clear the pile loops. Then latch openers are provided to open the needle hooks in preparation for their engaging the pile thread of the next feeder. The needle movement for the latch needles knitting the ground fabric can be effected according to one of the examples described in which the ground thread is fed behind the shafts of the needles knitting the pile loops. As needle selection is always carried out more easily in the cylinder, the knitting of the ground fabric should be effected by the cylinder needles.

Figure 7:
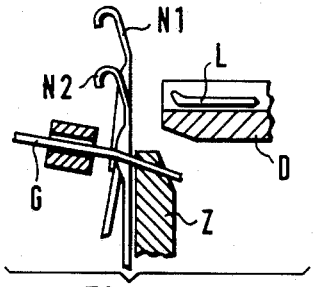
FIG. 7 is an elevation like FIG. 2 showing relative positions of knitting elements in another embodiment.
Figure 8:
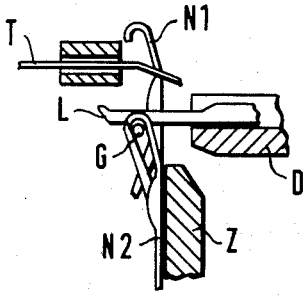
FIG. 8 is an elevation showing the same knitting elements as FIG. 7 in a different position.
Figure 10:
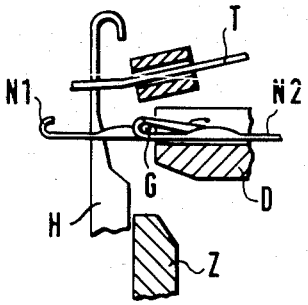

According to FIG. 7, the latch needles in the dial D can be replaced by so-called pile needles or pile sinkers L (cf. U.S. Pat. No. 1,221,756). The cylinder needles are controlled according to one of the previously described examples in an upper (N1) and a lower (N2) feeding position, or they stand, in a method according to FIG. 5, at the same height. The ground thread G is fed to the needles beneath the pile sinkers L, which can be simultaneously moved forward. It is, however, possible in machines with cylinder and dial already to move out before the cylinder needles the pile sinkers or the latch needles provided in the previous example for pile formation, as they do not affect the feeding of the pile thread. If the pile elements L are moved out before the knitting latch needles, they can also prevent the fabric moving with the rising needles. After feeding the ground thread, the needles—as described above—not intended to engage a pile thread are retracted to an intermediate position in which their heads just project over the pile elements. According to FIG. 8, the pile thread T is fed to the selected needles N1 and all needles brought to the knock-over position. When using pile needles or pile sinkers L, these remain extended until the stitches are knitted. Only then are they retracted clearing the pile loops (delayed timing).

Figure 9:
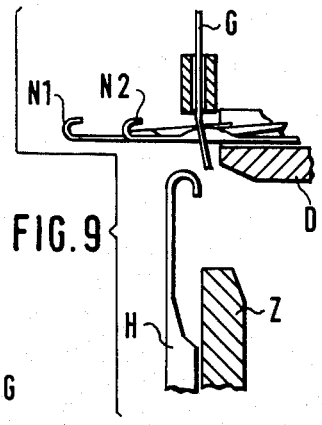
FIGS. 9, 9*a* and 10 are elevations like FIGS. 7 and 8 of an arrangement using a different arrangement of the knitting elements.
Figure 9A:
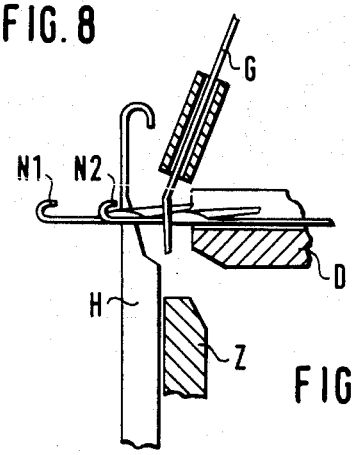
Figure 11:
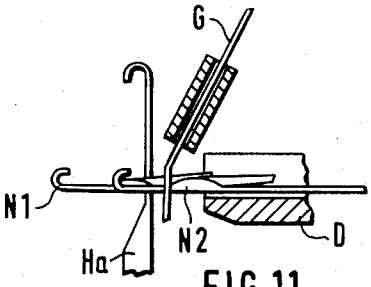
FIGS. 11 and 12 are elevations like FIGS. 7 and 8 of yet another arrangement.
Figure 12:
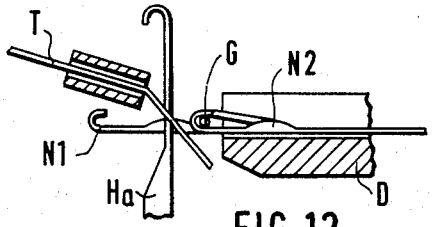

A further possibility lies in the use of pile hooks for forming the pile loops. These can be arranged either in the cylinder (DE-PS 1 816 846) or in the dial (U.S. Pat. No. 2,933,907, GB-PS 830 219). The pile hooks H are raised according to FIG. 9 after the ground thread G is fed or, according to FIG. 9*a*, they are already extended at this time. According to one of the previously described possiblities the needles are selected at different feeding positions or reach these after feeding of the ground thread G (FIG. 5). Before the feeding of the pile thread T according to FIG. 10 all needles N2 are withdrawn from the region of the pile hooks Ha. After the feeding of the pile thread, first the pile hooks and then the needles are retracted by the cams.

For plush knitting, however, pile hooks also provided with a cutting edge can be used, as known from DE-OS 2 535 197, DE-OS 2 704 295, DE-OS 2 918 903. The ground thread G and the plush thread T (FIG. 12) are fed in a manner already known from the previously described examples. Depending on the desired stitch structure, unproductive feeders are present, in which the pile hooks or cutting elements are actuated to cut the pile loops.

The use of machines with cylinder and dial has, particularly in knitting pile fabrics by means of the pile elements carried in the dial, the disadvantage that longer projecting pile threads (floats) can easily remain on the dial cam plate or between the dial and the dial cam plate. There are therefore provided suitable thread guide mechanisms which guide the exposed pile threads under the dial.

In order to produce colour patterned fabrics with denser pile using the above described examples, it is necessary at least partially to interrupt regular stitch formation from the ground thread in each region in which the pile thread misses. Simple needle controls are sufficient for partial knitting of the ground thread where this is used on its own. These will be supplemented and displaced by the known per se selection devices effecting the selection of the needles knitting the pile threads.

Figure 13:
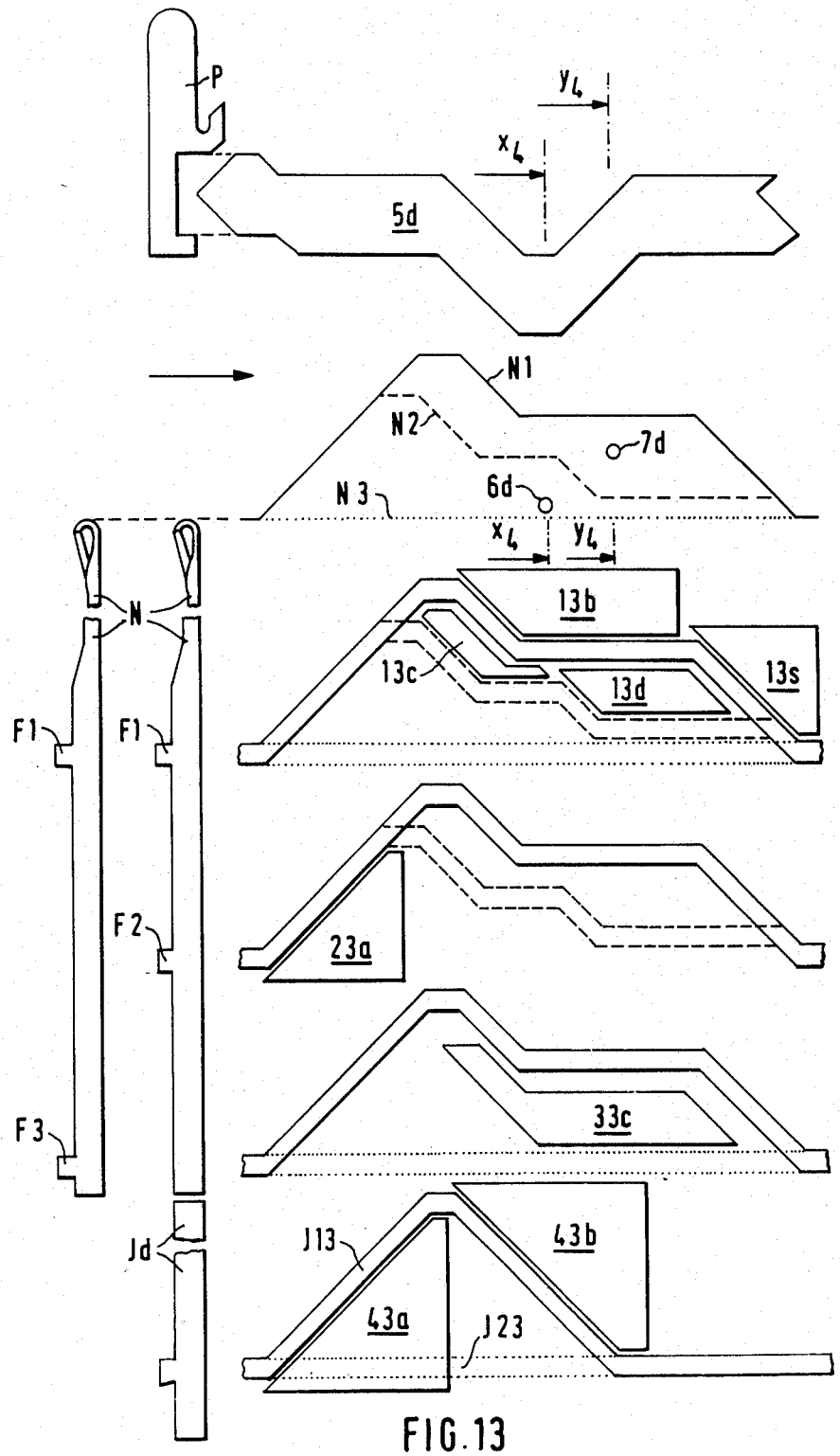
FIGS. 13–16 are schematic diagrams like FIG. 1 showing different cam sections that can be used in carrying out different embodiments of the invention.

FIG. 13 shows an example of knitting a denser colour patterned pile fabric. The needles have generally a working butt F1 and some of the needles have additional patterning butts F2 or F3 respectively. One of these sets of patterning butts can be replaced by a high butt model of working butt F1. The needles can obviously have further sets of butts or intermediate jacks can be provided with differently arranged butts or butts at different heights below the needles having only one butt. Preferably, the needles are interchangeably arranged with the patterning butts F2 or F3 in the cylinder.

In FIG. 13 the selection process already described in FIG. 6 is used for knitting the pile thread. Consequently, the selected needles N1 provided for knitting the pile thread will be raised up by cooperating jacks J*d* along path J13 over the knitting position by cam section 43*a*, while of the needles not selected by the patterning device, those with pattern butts F2 will be raised to the knitting position N2 by cam section 23*a*. All unselected needles with pattern butts F3 or without pattern butts F2, F3 remain in the miss position. The further progress of the needle control is now according to the description of FIG. 6. The needles N1 selected by the patterning device and raised above the knit or clearing position are retracted by cam section 13*b* into an upper feeding position which lies above needles with butts F2 raised by cam section 23*a* and retracted by cam section 13*c* into a lower feeding position. At the same time the sinkers P are retracted by cam 5*d* so that the ground thread can be fed by carrier 6*d* at X4 shown in FIG. 13. Also a cam section 33*c* guides the needles N3 in the miss position so that they do not rise above the knock-over edges of the sinkers where they could jam up against the ground thread carrier.

After feeding the ground thread the sinker nebs are moved between the needle shafts and the needles N2 selected by their pattern butts F2 are retracted by cam section 13*d* so far that their hooks close and are positioned just over the sinker nebs. Now the feeding of the pile thread by carrier 7*d* is effected at Y4 shown in FIG. 13, and after that also the retraction of all needles by the stitch cam 13*s*. In those parts of the course knitted from selected needles N1, ground and pile threads form stitches simultaneously forming pile loops connecting the stitches. In parts of the course in which the pile thread misses, each needle N2—raised on butt F2—will knit a stitch with the ground yarn only.

If—additionally—the sequence of needles is: (F1,F2), (F1), (F1,F3), (F1), (F1,F2) etc. where (F1,F2) indicates a needle with butts F1 and F2, then in non-selected parts of the course the ground thread is knitted to stitches only on each fourth needle and will therefore miss three needles or stitches. The floats of the ground thread should, however, not be too long, so that they cannot be raised too far from the ground fabric surface. It is left to the expert to decide in what order should be selected those needles that are not selected by the pattern butts F2, F3 in the subsequent feeder positions. Corresponding to the description of FIG. 13, corresponding cam sections are provided for the butt cam-tracks for butts F2 and F3. Further knitting structure variations involve raising the unselected needles by pattern butt F2 into the knit or clearing position and by pattern butt F3 into the tuck position or alternately at subsequent feeders.

Figure 23:
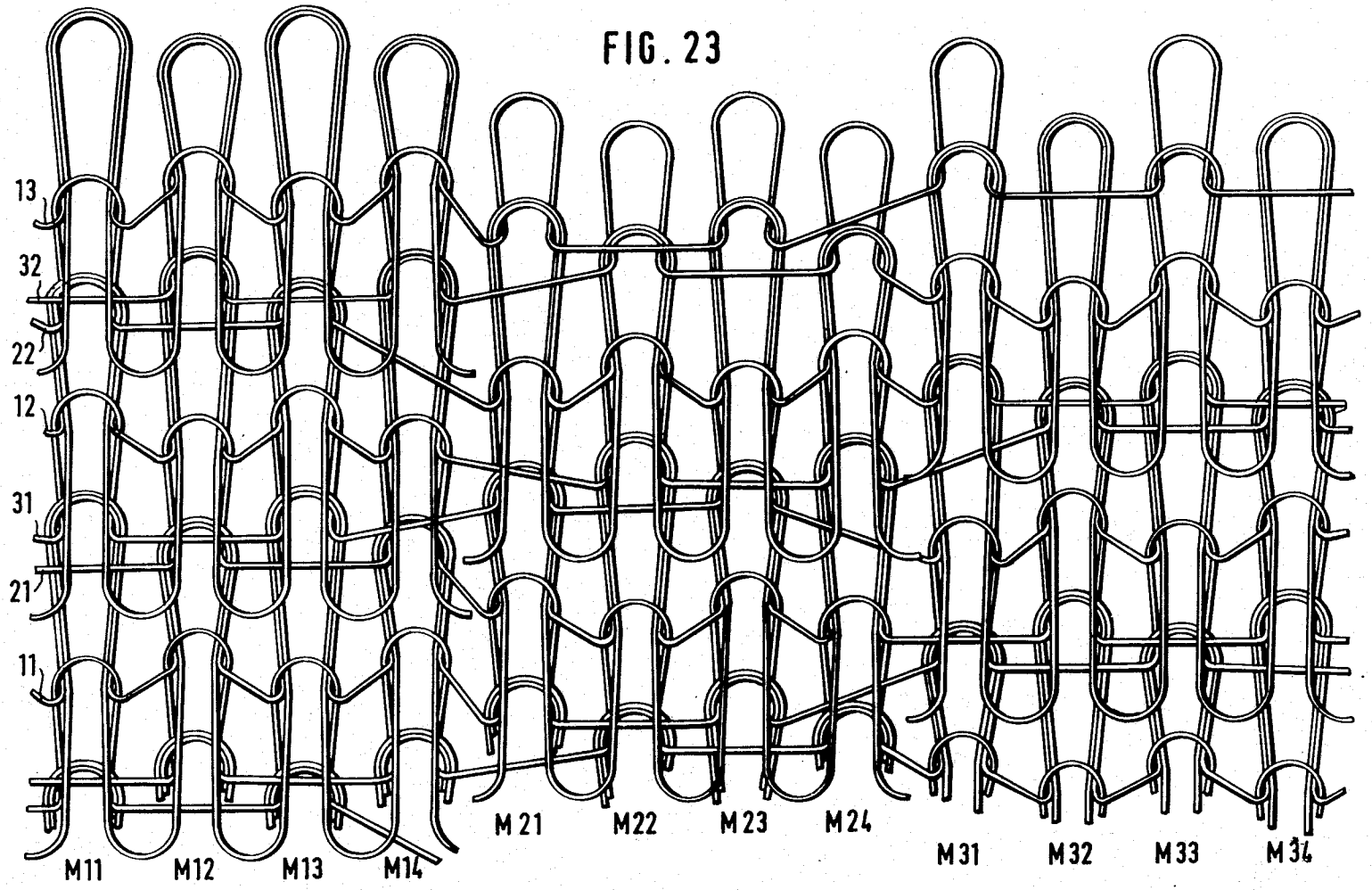
FIG. 23 is a representation like FIG. 22 of a second such fabric.

FIG. 23 shows a three colour patterned pile fabric produced according to FIG. 13. In the wales M11, M12, M13 and M14 first pile threads are knitted together with the ground threads 11, 12 and 13. In this region the ground threads 21 and 22 or 31 and 32 are single knitted in every second wale only. In the region of the wales M21, M22, M23 and M24 the stitches of the ground threads 21 and 22 bind in the second pile thread, while the ground threads 11, 12 and 13 or 31 and 32 are single knitted in every second wale only. In the wales M31, M32, M33 and M34 on the other hand the ground threads 31 and 32 are knitted together with pile threads and the ground threads 11, 12 and 13 or 21 and 22 are single knitted in every second wale. Consequently two complete courses are knitted by three feeders, whereby at any given time pile loops of different material are bound in step-wise. Consequently, the pile density of this three colour fabric corresponds to that of the previously known two colour pattern.

To produce the fabric shown in FIG. 23 using the arrangement illustrated in FIG. 13 involves the following steps: The ground thread 11 and a first pale thread are fed at a first feeder, where needles N1 form wales M11–M14, needles N2 form wales M21, M23, M31 and M33, and needles N3 form wales M22, M24, M32 and M34. At the second feeder, needles N1 form wales M21–M24, needles N2 form wales M12, M14, M21 and M23, and needles N3 form wales M11, M13, M22 and M24. At this second feeder, the ground thread 21 and a second pile thread are fed. At a third feeder are fed the ground thread 31 and a third pile thread, the needles N1 forming wales M31–M34, needles N2 forming wales M11, M13, M21 and M23 and needles N3 forming wales M12, M14, M22 and M24. At the fourth feeder, the first pile thread is fed on the other hand, as the ground thread, the needles N1 forming wales M11–M14, needles N2 forming wales M22, M24, M32 and M34 and needles N3 forming wales M21, M23, M31, and M33. At the fifth feeder, the ground thread 22 and a second pile thread are fed. Here, needles N1 form wales M21–M24 as at the second feeder, needles N2 form wales M11, M13, M31 and M33, the needles N3 form wales M12, M14, M32 and M34. At the sixth feeder, at which the ground thread 32 and a third pile thread are fed, needles N1 form wales M31–M34, needles N2 form wales M12, M14, M22 and M24 and needles N3 form wales M11, M13, M21 and M23. The pattern at the first sixth feeders is repeated over the seventh and subsequent feeders.

The example described according to FIG. 13 can also be carried over on to machines with cylinder and dial. As the ground thread is only either single knitted or knitted together with a pile thread, no auxiliary sinker ring is necessary.

Figure 15:
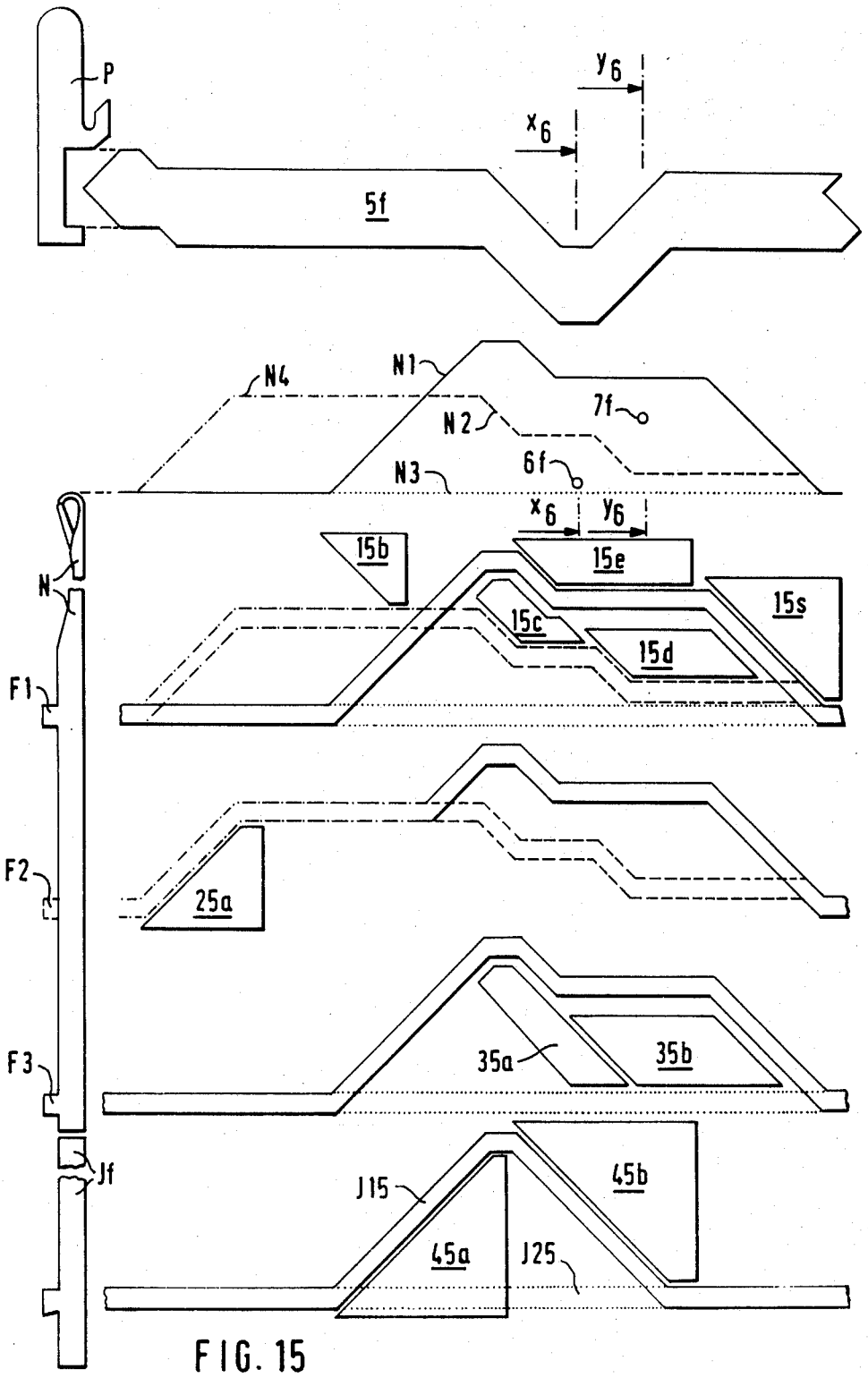
Figure 16:
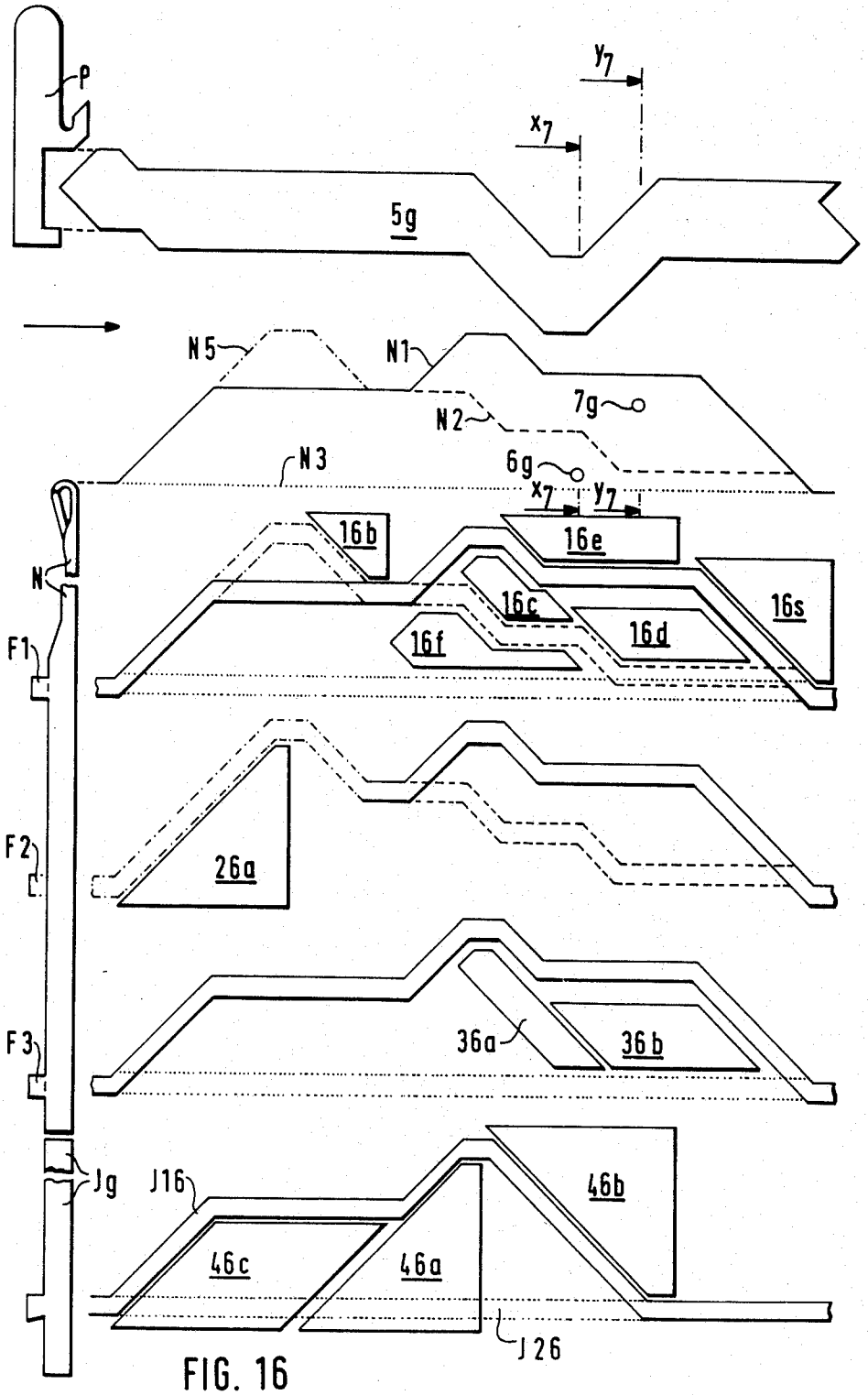

In FIG. 16 a further example is shown using the selection principle shown in FIG. 1. In this, first, all needles N5 with pattern butts F2 (see FIG. 13—the needles with butts F1, F2, F3 apply equally to FIGS. 14, 15 and 16) are raised to the knit or clearing position by cam **26*a* and retracted by cam section 16*b* into a lower feeding position. Of the remaining needles, cam 46*c* of the patterning device raises to the tuck position (which is identical with the lower feeding position of the needles with butts F2) the selected needles with the pattern butt F3, while the remaining needles with the pattern butt F3 remain in the miss position. After cam section 16*b* the patterning device now raises the needles N1 provided for engaging the pile thread from the tuck position (pattern butt F3) or the feeding position (pattern butt F2) into the knit or clearing position by cam 46*a*. Cam section 16*c* retracts the unselected needles N2 into a lower feeding position, while the selected needles N1 are retracted into an upper feeding position by the cam section 16*e*. After feeding the ground thread by carrier 6*g* at X7, shown in FIG. 3, cam section 16*d* retracts the needles from the lower feeding position into an intermediate position in which the needle hooks are closed and project only so that their heads are over the sinker nebs that have been moved between the needle shafts. After feeding the pile thread by carrier 7*g* at Y7, shown in FIG. 4, all needles are retracted to the knock-over position by the stitch cam 16*s*. It is also possible, by cam section 16*b*, to retract all raised needles into a lower feeding position, whereby the needles N2 which have not been raised by the patterning device must subsequently no longer be brought into this position by cam section 16*c***.

In order to obtain the full pile density, it is only necessary, in the last described examples FIG. 13 and FIG. 16, to raise the needles which engage only the ground thread by the pattern butts F2 or in connection with a desired knitting cycle if necessary also by pattern butts F2 into the tuck position. Consequently all stitch forming between the pile knitting parts of a course is prevented; the ground thread which is single knitted is alternately tucking and missing (laying-in).

Figure 14:
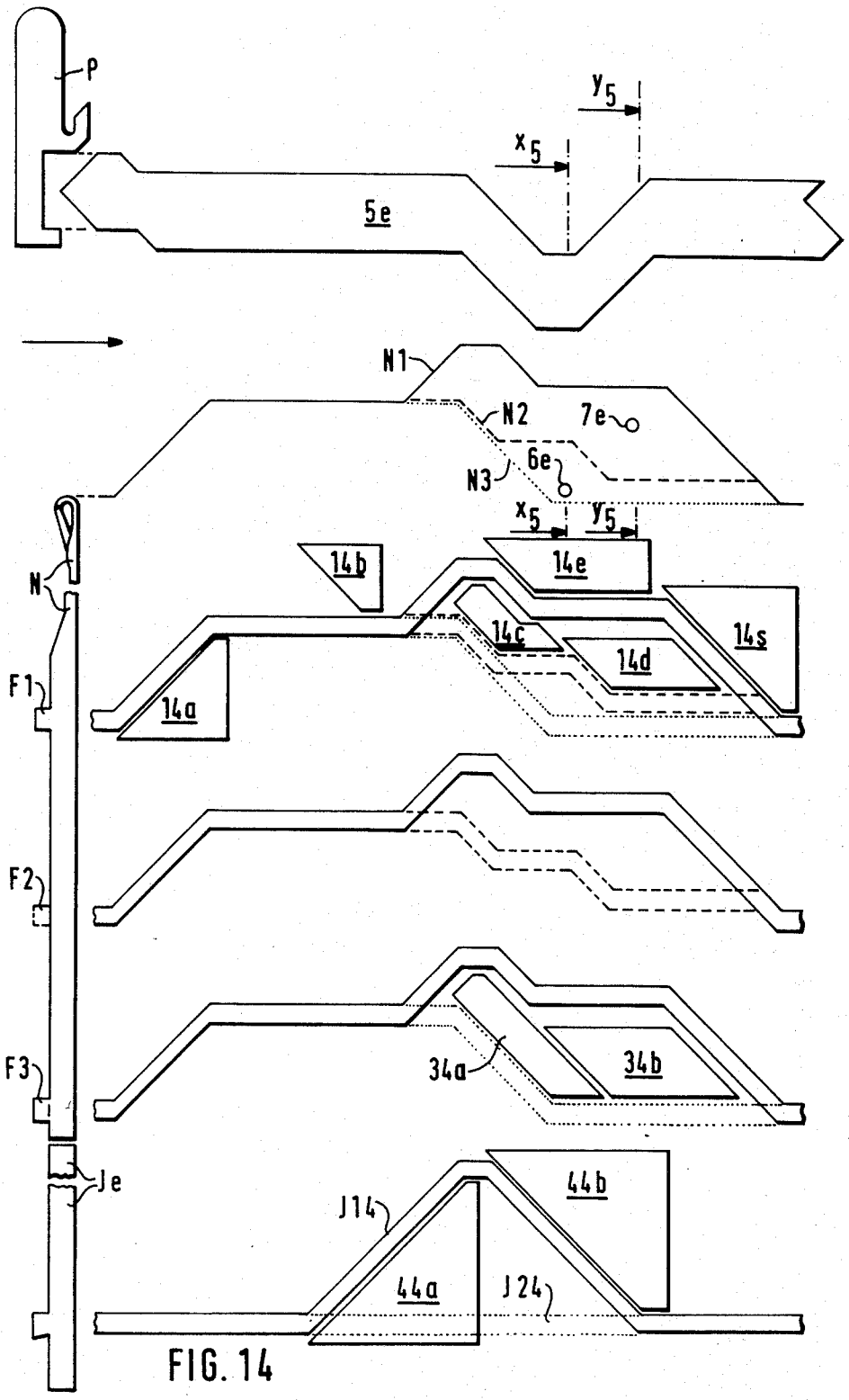

An example of the production of such a fabric is shown in FIG. 14. By cam section **14*a* all needles are raised to the tuck position. After cam section 14*b*, the needles N1 provided for engaging the pile thread are raised by cooperating jacks Je along path J14 into the knit or clearing position by cam 44*a* of the patterning device. All unselected needles are retracted by cam section 14*c* into a position corresponding to the lower feeding position, unselected needles N3 with pattern butts F3 retracted by cam section 34*a* into the miss position and guided by cam section 34*b*. Now the ground thread is fed by carrier 6*e* at X5 (FIG. 3), beneath the retracted sinker nebs and the tuck needles subsequently retracted on cam section 14*b* so that the needle hooks extend only so high that their heads are over the sinker nebs that have been moved between the needle shafts. After feeding the pile thread at Y5 by carrier 7*e*, shown in FIG. 4, all needles are then retracted to the knock-over position by the stitch cam 14*s***.

FIG. 15 shows a further example. Here, initially all needles N4 are raised by cam **25*a* by their cooperating pattern butts F2 into the tuck position. Then follows the selection of the needles N1 provided for pile formation. Cam 45*a* of the pattern device raises jacks Jf along path J15—and cooperating needles from the tuck position needles with pattern butts F2 and from the miss position needles with butts F3 into the knit or clearing position. The unselected tuck needles N2, which are only raised by pattern butt F2, are now retracted into the lower feeding position by cam section 15*c*, while the selected needles N1 are retracted by cam section 15*e* into an upper feeding position. After feeding the ground thread at X6 by carrier 6*f*—shown in FIG. 3**—, the further needle control is the same as in the last described example.

As described in the examples according to FIGS. 15 and 16, by exchanging a few cams, different knitting structures can be chosen for single knitting the ground thread between the pile sections of a course. If the ground thread is knitted by a set of the needles as tuck stitches in each region in which it does not knit stitches together with the pile thread, then according to FIG. 14, and FIG. 15 the needles already raised to the tuck position can be retracted by cam section **14*d* or 15*d* to an intermediate position in which they extend only with their hooks over the sinker nebs. The deep feeding of the ground thread and its associated feeding into the throats of the sinkers assures a proper thread guiding. In such cases the retracting cam sections 14*c*, 15*c* and 14*d*, 15*d* are unnecessary, or a cam section corresponding to the section 14*d*, 15*d* could retract the tuck needles N2 to a position in which the needles N2** stand with their heads on a level with the upper edges of the sinker nebs, or with the hooks over the knock-over edges of the sinkers.

A further possibility lies in raising all needles or those provided for the tuck knitting, so opening the needle hooks and—so far as no selection results—retracting them into the miss position. Shortly before feeding the ground thread, the needles provided for the tuck knitting are raised to an intermediate position in which their heads are just positioned over the sinker nebs. As the hooks were previously opened, it is ensured also by such a needle guiding that the ground thread is safely laid into each needle which single knits it into tuck stitches.

In order to avoid needle selection in an upper and a lower feeding position according to FIG. 5, the jacks of the patterning device are pivotally connected to the latch needles which are selectable by at least two rows of butts like butts F1 and F2 or F3 of FIG. 13. In this way, the needles can be raised and retracted by selected pattern jacks. A knitting cycle begins with the patterning device raising selected needles into the knit or clearing position. According to the desired stitch formation of the ground thread which is to be single knitted, simultaneously unselected needles, according to the pattern, are brought into the knitting or the tuck position at least by one of the pattern butts F2 or F3. When the needles raised by the selection device have been raised to the knit or clearing position, this selection is cancelled. While the needles that have been raised to the knit or clearing position are retracted by their working butts according to FIGS. 14–16 by a cam section 14*b*, 15*b*, 16*b* to the feeding position or to the needles raised to the tuck position, an additional selection of the jacks is effected. Now either each pattern jack of the needles previously raised just by one of the pattern butts, or all of the previously unselected needles are brought into contact with a cooperating retracting cam section. This retracts the needles or jacks raised only by the pattern butts F2 or F3, after the feeding of the ground thread, into an intermediate position in which the needle hooks extend with their hooks just over the sinker nebs moved between the needle shafts. The needles remaining in the feeding position have the pile thread fed to them, whereon all needles are retracted to the knock-over position by the stitch cam SN. In contrast to what has previously been described, the needle selection by the corresponding control means (e.g. pattern wheels) can naturally be carried out in all three knitting positions. This is also possible for the retraction of the needles which in any event can be effected by e.g. correspondingly supported pattern wheels.

A colour patterned pile fabric is shown in FIG. 24. Here, first pile threads P11, P12 and P13 are knitted with ground thread G11, G12 and G13 in the wales M1, M2, M3 and M4. In this region, the ground threads G21 and G22 are tucked into every second wale, and joined by thread floats. In the connecting region comprising the wales M5, M6, M7 and M8, the ground threads G21 and G22 knit common stitches with the two pile threads P21 and P22, whereby the ground threads G11, G12 and G13 are tucked into every second wale (M6 and M8). It lies within the capability of the expert to change the tucking of the ground threads walewise (M1 to M4) or to leave them unchanged (M5 to M8), or to prescribe a different knitting cycle.

As illustrated, however, the fabric of FIG. 24 can be produced according to FIGS. 14 and 15. At a first feeder a ground thread G11 and a first pile thread P11 are fed. The needle control for wales M1–M4 is here on track N1, that of wales M6 and M8 on track N2 and that of wales M5 and M7 on track N3. At the second feeder a ground thread G21 and a second pile thread P21 are fed and the needles for wales M5–M8 are controlled on track N1, those for wales M2 and M4 on track N2 and those for wales M1 and M3 on track N3. At the third feeder, a ground thread G12 and a first pile thread P12 are fed. As the tucking of the ground thread G12 corresponds to that of the ground thread G11, the needles are controlled as previously at the first feeder. At the fourth feeder a ground thread G22 and a second pile thread P22 are fed. Wales M5–M8 are again controlled on track N1, those for wales M1 and M3 on track N2 and the needles forming wales M2 and M4 on track N3. Then a further cycle begins again.

In the previously described examples, a maximum of safety in the thread guiding is achieved by the feeding the pile thread over the sinker nebs after the feeding of the ground thread below the sinker nebs, but the selection of the needles into two feeding positions requires special provision (needles with longer latches). The selection and guiding of needles into two feeding positions can be avoided by feeding the pile thread in the knit or clearing position before the feeding of the ground thread.

Figure 17:
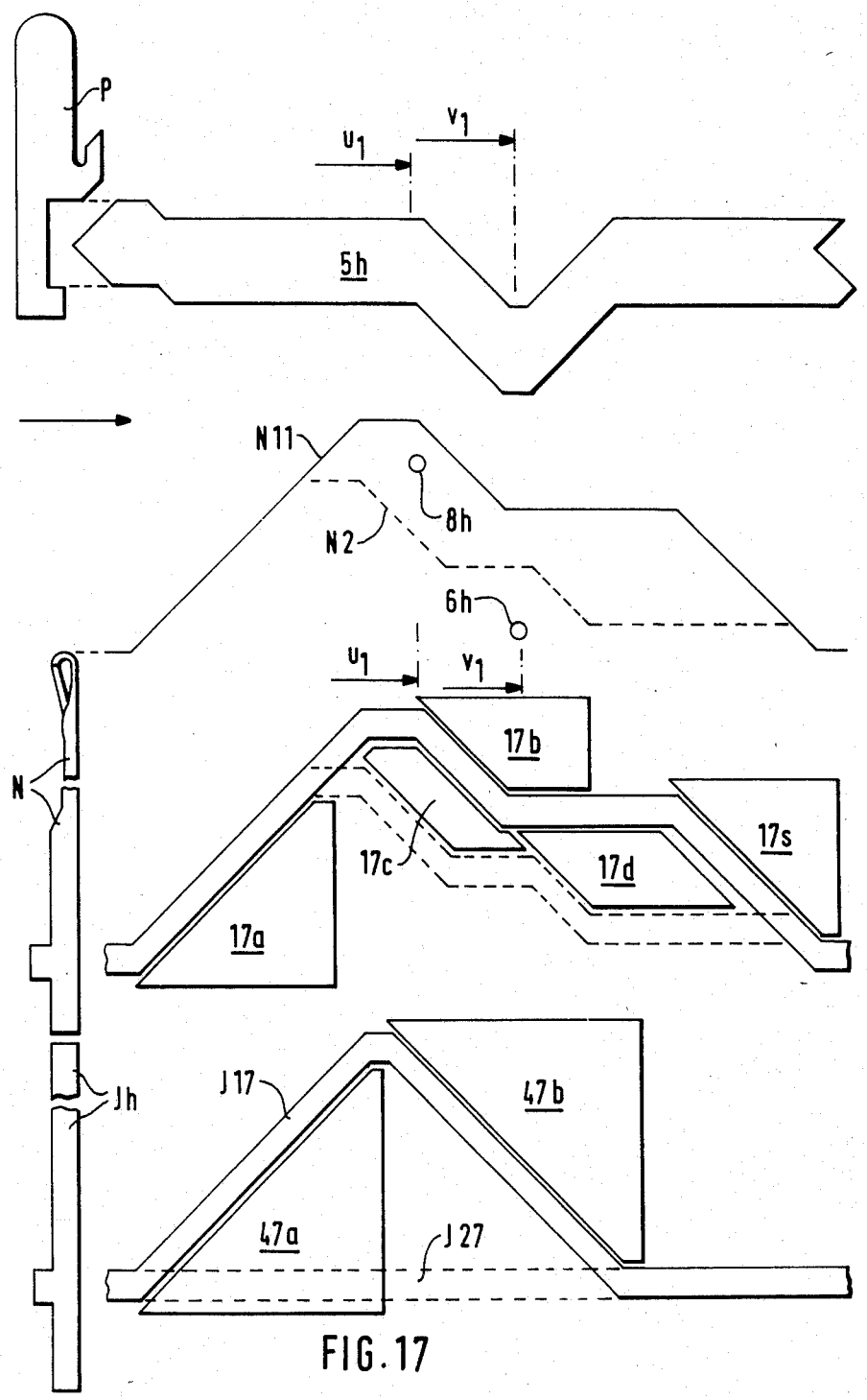
FIG. 17 is a further schematic diagram showing yet a further cam section embodiment.
Figure 18:
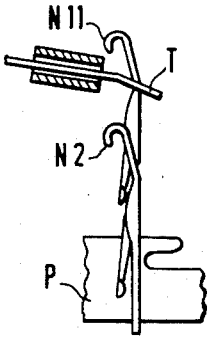
FIG. 18 is an elevation like FIG. 2 showing the relative positions of knitting elements at a position corresponding to "U" in FIGS. 17, 20 and 26.

One example of this method is shown in FIG. 17. Proceeding from FIG. 6, all needles are raised to the knit or clearing position by cam section 17*a*, selected needles being raised above this by cam 47*a* and cooperating jackets Jh along path J17. While the unselected needles N2 are retracted by cam section 17*c* as far as possible to the feeding position, the retraction of the selected needles N11 by the cam section 17*b* only takes place after a pile thread T is fed to them at the position U1 in FIG. 17 in the highest possible position, as shown in FIG. 18. After the selected needles N11 are retracted to the feeding position by cam section 17*b* (FIG. 17, position V1), the ground thread G is, according to FIG. 19, fed by feeder 6*h* beneath the retracted sinker nebs and these are then moved between the needle shafts. By feeding the pile thread by feeder 8*h* at a relatively high level, it lies above the sinker nebs. If necessary, the unselected needles are retracted by a cam section 17*d* to a position in which the needles remain with their (closed) hooks over the sinker nebs. As a result the pile threads touch the unselected needles only shortly before all needles are retracted by the stitch cam 17*s*. In order better to guarantee the positioning of the pile thread behind the unselected needles, needles with forwardly bent plating heads are used. Consequently, it is also possible to avoid a selection into different feeding positions.

If also, according to FIG. 17, in the sections of courses where the pile thread is missing, the ground thread is knitted as tuck loops or stitches on only some of the needles, then reference is made to controlling the needles as described in connection with FIGS. 13–16. However, pattern devices according to FIGS. 14–16 can be used. According to the desired pile density, all the needles will be raised to the knit or clearing position or some of them by one of the needle butts into the tuck or knit position. If needles are raised into the knit or clearing position they are subsequently retracted by cam section 14*b*, 15*b* or 16*b* into the feeding position. Then the patterning device raises selected needles into the knit or clearing position or, if a safer feeding of the thread is demanded, above this, The pile thread T is fed according to FIG. 17 and, after retraction of the selected needles N11 into the feeding position by cam section 17*b*, the ground thread is fed according to FIG. 19. After the sinker nebs are moved between the needle shafts, all the needles are retracted to the knock-over position by the stitch cam 17*s*.

The combination of the two described feeding techniques for the pile thread makes it possible, contrary to DE-PS 671 333, with a coursewise changing needle selection and adequate spacing of the individual needle sets one from the other, to knit with two pile threads and one ground thread at the same feeder.

Figure 19:
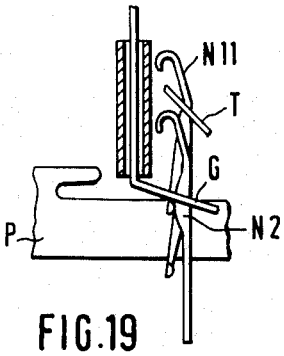
FIG. 19 is an elevation like FIG. 18, but corresponding to "G" in FIG. 17.
Figure 21:
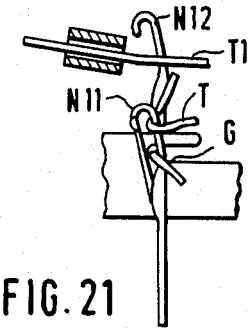
FIG. 21 is an elevation like FIGS. 18 and 19 showing the relative positions of knitting elements at a position corresponding to "Z" in FIGS. 20 and 26.
Figure 20:
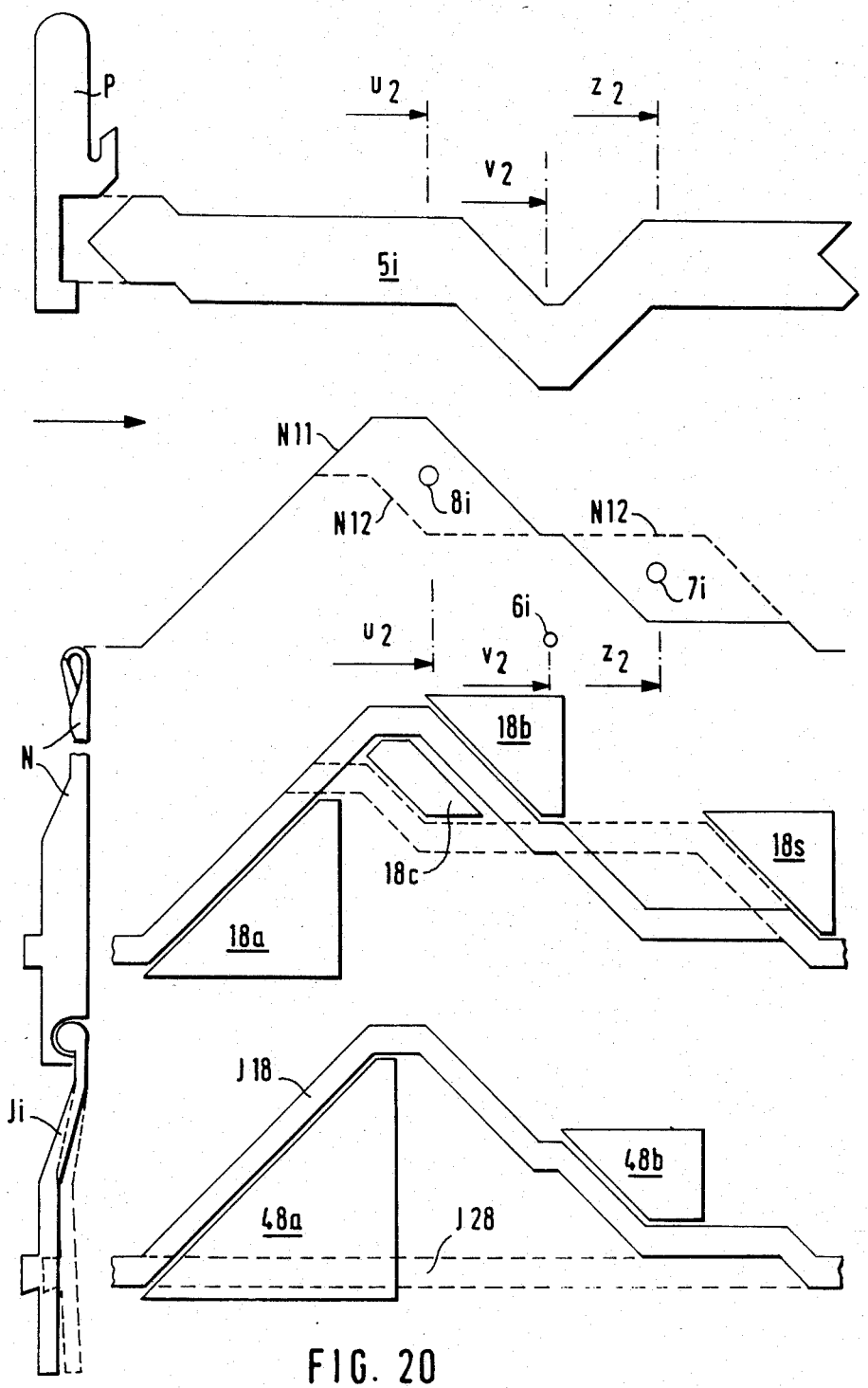
FIG. 20 is another schematic diagram like FIG. 17.

A corresponding example is shown in FIG. 20. Here, a patterning device is used, by which the needles can be raised and lowered by the pattern jacks Ji according to FIG. 5. At the beginning of the knit cycle all needles are raised to the knit or clearing position by cam section 18*a*, cam 48*a* of the selection device raising needles N11 above that level. Cam section 18*c* retracts the unselected needles N12 into the feeding position. After feeding the pile thread T (FIG. 20, position US—shown in FIG. 18) the selected needles N11 are retracted also to the feeding position by cam section 18*b* and the ground thread is fed (FIG. 20, position V2—shown in FIG. 19). While the sinker nebs are moved between the needle shafts, the selected needles N11 are retracted again by cam 48*b* of the patterning device and cooperating jacks J18 to an intermediate position in which their hooks just reach over the sinker nebs. These needles N11 guide the pile thread T with their hooks closed over the nebs of the pile sinkers, while the unselected needles N12, behind the shafts of which the pile thread T misses, remain in the feeding position. The previously unselected needles N12 are now according to FIG. 21 fed with a second pile thread T1 (FIG. 20, position Z2) and then the stitch cam 18*s* retracts all needles to the knock-over position. The needles selected by the patterning device consequently knit the first pile thread, all others, the second pile thread, and thereby knit alternating pile loops according to the needle selection.

A further possibility of needle control comprises raising all needles into the knit or clearing position and retracting selected needles into the feeding position. While the unselected needles are fed with a first pile thread and are then retracted by their working butt F1 into the feeding positions, the needle selection is cancelled and now all needles are selected that before were unselected. These needles, which previously engaged the first pile thread, are now, while the sinker nebs are moved between the needle shafts, retracted to an intermediate position in which they stand with their heads just over the sinker nebs. After the second pile thread T1 is fed to the remaining needles, all the needles are retracted by the stitch cam to the knock-over position.

Figure 25:
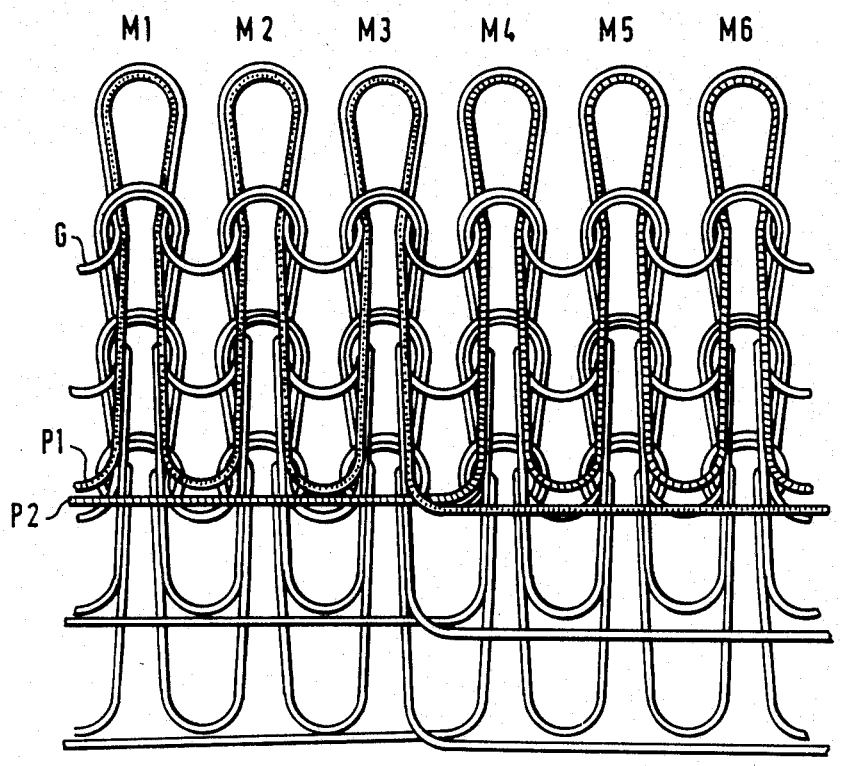

In order to avoid this double needle selection or raising the needles above the knit or clearing position, all needles can first be raised to the knit or clearing position according to FIG. 1 and then retracted to the feeding position. Then the patterning device raises selected needles to engage the first pile thread and, after they have been retracted to the feeding position and been fed with a ground thread, and the sinker nebs have been moved between the needle shafts, retracts them (the selected needles) to an intermediate position in which the needle heads with the first plush thread in their hooks just extend over the sinker nebs. After feeding the second pile thread T1 to the needles remaining in the feeding position, all needles are retracted by the stitch cam SN. The fabric shown in FIG. 25 can be made according to one of the previously described examples. There is indeed only a simple lengthwise stripe pattern disclosed in which first pile threads P1 in wales M1, M2 and M3 and second pile threads P2 in wales M4, M5 and M6 are knitted with ground threads, but by means of the needle control according to the invention, the needle selection and thereby the number of consecutive stitches formed by the two pile threads can be varied.

It is however also possible to knit the two pile threads alternately with the ground thread only on a proportion of the needles and in each region in which neither of the pile threads knits, to single knit the ground thread by all or some of the non-selected needles into stitches and/or tuck stitches. If two feeders knit a complete course, already four different pile threads would be knitted in it.

Figure 26:
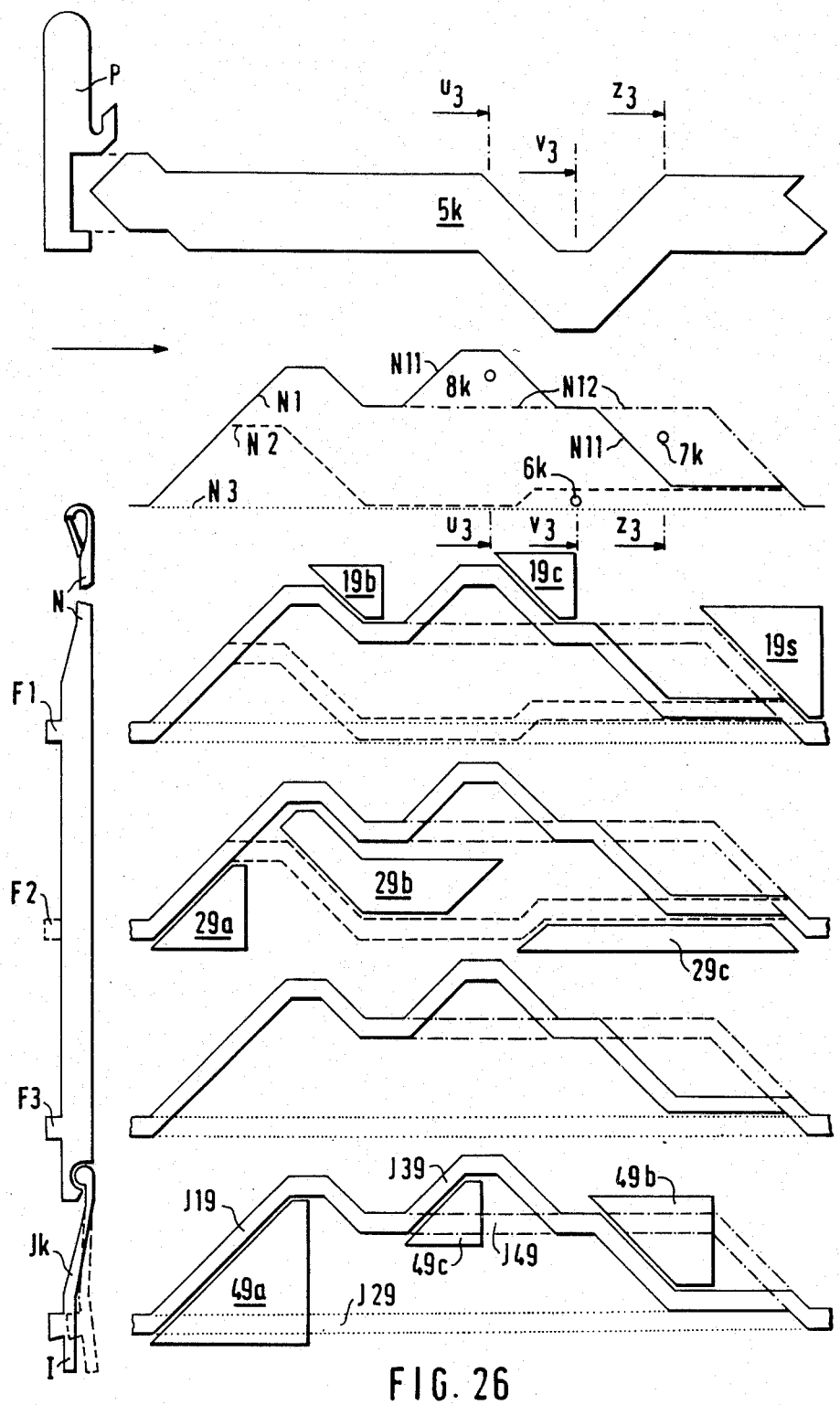
FIG. 26 is a schematic diagram like FIG. 1 of another invention embodiment.

One example is shown in FIG. 26. Into the needles, having working butts F1 and preferably having alternately pattern butts F2 or F3, are inserted pattern jacks Jk to be reciprocated by a pattern selection device. These pattern jacks are reciprocated by the selection device in the operative position J19, J39 or inoperative position J29, J49. At the start of a knitting cycle the selected pattern jacks J19 are brought into the working position I, and their needles will engage one of the pile threads. These needles N1 are raised by the pattern jacks Jk along path J19 by the cam section 49*a* into the knit or clearing position and retracted by cam section R1 19*b* into the feeding position. Of the unselected needles, each needle N2 with a pattern butt F2 is raised to the tuck position by cam section 29*a* for opening the latches and retracted by cam section 29*b* into the miss position. During the retraction of the selected needles N1 into the feeding position a further selection of the pattern jacks Jk is carried out. Only those pattern jacks remain in the operative position I, of which the needles N11 will engage the first pile thread. Therefore they are raised by the cam section 49*c* into the knit or clearing position again, while the remaining needles N12 previously raised to the knit or clearing position remain in the feeding position. The needles N11 are fed with a first pile thread, from feeder 8*k* at U3—shown in FIG. 18—and cam section 19*c* retracts them back into the feeding position. Of the unselected needles the needles N2 provided for the tuck knitting are simultaneously raised by cam 29*c* to an intermediate position in which their heads just extend over the sinker nebs. The ground thread is not fed by feeder 6*k* beneath the sinker nebs at V3—illustrated in FIG. 19—and the sinker nebs moved between the needle shafts. The pattern jacks J*k* that are in their operative position I are now retracted, with their needles N11 by cam section 49*b* to an intermediate position in which their hooks just project over the sinker nebs. The needles 12 remaining in the feeding position are fed with the second pile thread by feeder 7*k*—shown in FIG. 21—and then the stitch cam 19*s* retracts all needles to the knock-over position.

The needles N2 provided for tuck knitting can, after being raised to the tuck position, also remain there. Thus cam section 29*b* is dispensed with, so that the needles N2 remain at one height with the needles N12 projecting in the feeding position. As the needles N2 must not engage the second pile thread, it is necessary to bring their cooperating jacks into the operative position I and by the cam section 49*c* either the pattern jacks of these needles or all pattern jacks put out of action in the first selection, so that these tucking needles N2 are retracted by their pattern jacks through the cam section 49*b* out of the region of the second pile thread feeder. This must also be done if, in the regions where the pile threads are floating, all or some of the unselected needles should knit single stitches with the ground thread only. For this purpose e.g. needles with a pattern butt F2 will be raised by a corresponding cam section 29*a* or all needles will be raised by their working butts into the knit or clearing position and retracted to the feeding position by cam section 19*b*. Selected needles are now raised once again by their pattern jacks by cam section 49*c*. While they are retracted by cam section 19*c* having been fed with the first pile thread, the pattern jacks are re-selected. In the operative position all pattern jacks (the needles of which should also not engage the second pile thread) are now brought additionally to the previously selected pattern jacks so that these needles are retracted by cam section 49b, before the second pile thread is fed, to an intermediate position in which their needle heads just project up over the nebs of the sinkers. After feeding the second pile thread, the stitch cam retracts all needles to the knock-over position.

In a further example, all needles chosen for engaging one of two pile threads or to knit the ground thread only are selected and raised to the clearing position. As described above, also, desired needles can be raised by one of the butts F2 or F3 into the tuck position. A second selection is made to retract to the feeding position all needles which should not engage the first pile thread. This is fed to the needles remaining in the clearing position. Then these needles will also be retracted to the feeding position. During this retraction, a further selection is effected, the sinkers being retracted so that the ground thread can be fed. The sinkers will then be moved so that their nebs are positioned between the needle shafts. The selected needles which have engaged the first pile thread or will knit or tuck the ground thread only and which should not engage the second pile thread, will be retracted to an intermediate position in which they extend with their hooks just over the sinker nebs. After feeding a second pile thread to the needles remaining in the feeding position, all needles are retracted to the knock-over position by the stitch cam.

If colour patterning is produced by knitting partial courses on each feeder, corresponding feeders must cooperate as is well known to the expert to form a complete course.

Obviously fabrics can have stitch courses knitted according to the invention and stitch courses knitted in known manner, or threads can be additionally knitted in known manner.

The examples described should be taken as only a general indication of the possible manufacturing methods for the production of patterned pile fabric, combinations with known methods and combinations with each other being obviously possible.

I claim:

1. A method for knitting patterned pile fabrics on circular knitting machines having latch needles and pile elements having pile forming edges movable between the shafts of the needles to form pile loops, comprising the steps of (a) selecting a first set of needles for receiving only ground thread and a second set of needles for receiving ground thread and, also, pile thread for forming pile loops, said selection comprising selecting groups of adjacent needles for forming pile loops (b) raising all thus-selected needles (c) feeding ground thread to all selected needles (d) moving the pile elements between the needles without any selection of the pile elements and (e) holding only said first set of needles at an intermediate level at which the hook opening is below the level of the pile forming edges of the pile elements, but not yet so far as to form stitches, so that said hook openings are rendered inaccessible to pile thread by the presence of the pile forming edges (f) said ground thread feeding, pile element moving and needle first set retracting steps being carried out in relation to each other so that the ground thread lies, after such steps, completely below the level of the pile forming edges in the hooks of the needles of the first set and on the latches of the needles of the second set (g) feeding pile thread to said second set of needles while they stand with their hooks open above the pile forming edges and while said first set of needles is at said intermediate level as aforesaid and inaccessible to pile thread, and (h) retracting all selected needles to the knock-over position as a result of which said second set of needles takes up said pile and ground thread into the hooks of said second set needles and knits pile loops and the base fabrics.

2. A method according to claim 1, in which said first set of needles is raised to the tuck position only to open their hooks and then retracted to said intermediate level, while said second set of needles is raised to a higher level.

3. A method according to claim 1, in which the pile elements comprise pile sinkers with nebs defining throats, said intermediate level being at the level of the throats.

4. A method according to claim 1, in which needles not selected for the first or second set remain in the miss position.

5. A circular knitting machine for knitting patterned pile fabrics, having latch needles and pile elements with pile forming edges movable between the shafts of the needles, comprising (a) selection means for selecting a first set of needles for receiving only ground thread and a second set of needles for receiving ground thread and, also, pile thread for forming pile loops, said selection means being arranged to select groups of adjacent needles for forming pile loops, (b) actuating means for the pile elements for moving them between the needle shafts without any selection thereof, (c) a first feeder for feeding a ground thread to all selected needles at a first position, (d) cam means holding said first set needles after they have been fed with ground yarn at an intermediate level at which the hook opening is below the level of the pile forming edges of the pile elements but not so far below as to form stitches and so that said hook openings are rendered inaccessible to pile thread by the presence of the pile forming edges, and holding said second set needles with their latches open and above the pile-forming edges of said sinkers so that ground thread fed to said first set needles lies in the hooks of said first set needles and on the latches of said second set needles (e) a second feeder for feeding pile thread to said second set of needles at a position where they stand with their hooks open above the level of the pile forming edges and where said first set of needles is at said intermediate level and inaccessible to said pile thread, and (f) retracting cam means for retracting all selected needles to the knock-over position.

6. A method for knitting patterned pile fabrics on circular knitting machines having latch needles having hook openings and pile elements having pile forming edges movable between the shafts of the needles to form pile loops, comprising the steps of:

(a) selecting a first set of needles for receiving only ground thread and a second set of needles for receiving ground thread and, also, pile thread for forming pile loops said selection comprising selecting groups of adjacent needles for forming pile loops, as well as a third set of needles which receive no thread, (b) raising all needles to the tuck position, (c) subsequently raising said second set of needles to the clearing position and retracting them to a feeding position for feeding a pile thread thereto, (f) retracting said first set of needles to a feeding position for the ground thread and simultaneously retracting said third set of needles to a miss position, (e) feeding the ground thread to all needles of the said first and second sets, (f) moving the pile elements between the needles without any selection of the pile elements, and (g) retracting said first set of needles to an intermediate position at which the hook openings are below the level of the pile elements, but not yet so far as to form stitches, so that said hook openings are rendered inaccessible to pile thread by the presence of the pile forming edges, (h) said ground thread feeding, pile element moving and needle first set retracting steps being carried out in relation to each other so that the ground thread lies, after such steps, completely below the level of the pile forming edges in the hooks of the needles of the first set and on the latches of the needles of the second set, (i) feeding pile thread to said second set of needles while they remain in the feeding position for the pile thread with their hooks open above the pile elements and while said first set of needles is in said intermediate position as aforesaid and inaccessible to pile thread, and (j) retracting all said first and second set needles to the knock-over position as a result of which said second set of needles takes up said pile and ground thread into the hooks of said second set of needles and knits pile loops and the base fabric.

7. A method for knitting patterned pile fabrics on circular knitting machines having latch needles having hook openings and pile elements having pile forming edges movable between the shafts of the needles to form pile loops, comprising the steps of:

(a) selecting a first set of needles for receiving only ground thread and a second set of needles for receiving ground thread and, also pile thread for forming pile loops, said selection comprising selecting groups of adjacent needles for forming pile loops, (b) raising the first set of needles to the tuck position to open their hooks and then retracting said first set of needles to a miss position in which they do not take up thread, (c) simultaneously with said raising and retraction of said first set of needles to and from the tuck position, raising the second set of needles to the clearing position, (d) raising said first set of needles to an intermediate position at which the hook openings are below the level of the pile elements but in which the hooks can take up the ground thread, (e) feeding the ground thread to all selected needles, (f) moving the pile elements between the needles without any selection of the pile elements, (g) maintaining said first set of needles in said intermediate position, so that their hook openings are rendered inaccessible to pile thread, by the presence of the pile forming edges, (h) said ground thread feeding, pile element moving and needle first set retracting steps being carried out in relation to each other so that the ground thread lies, after such steps, completely below the level of the pile forming edges in the hooks of the needles of the first set and on the latches of the second set, (i) feeding pile thread to said second set of needles while they remain in the feeding position with their hooks open above the pile elements and while said first set of needles is in said intermediate position as aforesaid and inaccessible to pile thread, and (j) retracting all selected needles to the knock-over position as a result of which said second set of needles takes up said pile and ground thread into the hooks of said second set of needles and knits pile loops and base fabric.

* * * * *